US007968808B2

(12) United States Patent
Yamanaka

(10) Patent No.: US 7,968,808 B2
(45) Date of Patent: Jun. 28, 2011

(54) COMPOUND OPERATION INPUT DEVICE

(75) Inventor: Satoshi Yamanaka, Yao (JP)

(73) Assignee: Hosiden Corporation, Yao-shi (JP)

( * ) Notice: Subject to any disclaimer, the term of this patent is extended or adjusted under 35 U.S.C. 154(b) by 327 days.

(21) Appl. No.: 12/359,703

(22) Filed: Jan. 26, 2009

(65) Prior Publication Data

US 2009/0229963 A1 Sep. 17, 2009

(30) Foreign Application Priority Data

Mar. 14, 2008 (JP) ..... 2008-066029

(51) Int. Cl.
*H01H 25/00* (2006.01)

(52) U.S. Cl. ..... 200/4; 200/14; 200/406

(58) Field of Classification Search ..... 200/4, 14, 200/406; 341/35; 345/169, 184
See application file for complete search history.

(56) References Cited

U.S. PATENT DOCUMENTS

| | | | | |
|---|---|---|---|---|
| 5,593,023 | A * | 1/1997 | Kaizaki et al. | 200/570 |
| 6,546,231 | B1 * | 4/2003 | Someya et al. | 455/550.1 |
| 6,642,459 | B2 * | 11/2003 | Chou et al. | 200/11 TW |
| 6,680,444 | B1 * | 1/2004 | Lee | 200/4 |
| 6,943,305 | B2 * | 9/2005 | Kawamura et al. | 200/4 |
| 6,984,794 | B2 * | 1/2006 | Kawamura | 200/14 |
| 7,572,991 | B2 * | 8/2009 | Du et al. | 200/14 |
| 7,635,817 | B2 * | 12/2009 | Asada | 200/14 |
| 7,817,442 | B2 * | 10/2010 | Yamanaka | 361/799 |
| 2003/0099351 | A1 * | 5/2003 | Su | 379/419 |
| 2005/0150749 | A1 * | 7/2005 | Lung | 200/4 |

FOREIGN PATENT DOCUMENTS

| | | |
|---|---|---|
| JP | 59-98534 | 7/1984 |
| JP | 5-1125 | 1/1993 |
| JP | 9-274830 | 10/1997 |
| JP | 2005-243546 | 9/2005 |

OTHER PUBLICATIONS

Office Action dated Dec. 1, 2009 issued in the counterpart Japanese application No. 2008-066029 with English translation.

* cited by examiner

*Primary Examiner* — Michael A Friedhofer
(74) *Attorney, Agent, or Firm* — Kratz, Quintos & Hanson, LLP

(57) ABSTRACT

A compound operation input device of the invention includes: a body; a switch being disposed in the body and including a contact in an arcuate cross-sectional shape; and a lever. The lever includes: a basal portion disposed on a vertex of the contact; and an operating portion being swingable in swing directions and being depressible toward the switch from a predetermined position on a swing path. The body includes an arcuate abutting portion. The lever has a protrusion being disposed above the abutting portion. The abutting portion has a recess at a position thereof corresponding to the predetermined position. When the lever makes a depressing movement from a position other than the predetermined position, the protrusion abuts against the abutting portion. When the lever makes a depressing movement from the predetermined position, the protrusion is received in the recess such that the basal portion presses the vertex of the contact.

20 Claims, 15 Drawing Sheets

(a)

(b)

(a)

(b)

(c)

(a)

(b)

(c)

(a)

(b)

(a)

(b)

(a)

(b)

COMPOUND OPERATION INPUT DEVICE

BACKGROUND OF THE INVENTION

1. Field of the Invention

The present invention relates to a compound operation input device with an operating lever that is swingable in two opposite directions from a predetermined position, as well as being depressible.

2. Description of the Related Art

In a conventional compound operation input device of this kind, swinging the operating lever rightward or leftward from a predetermined position or depressing the operating lever downward causes a movable contact attached to the operating lever to move and selectively contact two of four stationary contacts provided on an inner wall surface of a body, whereby signals indicating the swing or depression are outputted.

This compound operation input device includes erroneous operation preventing means for preventing depression of the swung operating lever by abutting a projecting shoulder provided on either side of the operating lever against an outer edge of an opening in the body (see Japanese Unexamined Utility Model Publication No. 59-098534).

However, the erroneous operation preventing means has an intrinsic drawback since depression of the operation lever is prevented by means of abutment of the shoulders against the outside edges of the body. More particularly, when the operating lever is not inclined to a position proximate to a outside edge of the opening in the body (i.e., when the operating lever is at a position proximate to the predetermined position), the shoulders do not abut against the outside edges and are unable to prevent depression of the operating lever.

SUMMARY OF THE INVENTION

The present invention was made in view of the foregoing circumstances. It is an object of the invention to provide a compound operation input device capable of suitably preventing depression from a position other than a predetermined position.

In order to overcome the above problem, a first compound operation input device of the invention includes: a body; a press switch disposed in the body, the press switch including a first movable contact in a substantially arcuate cross-sectional shape; an operating lever; and a movement detecting part, provided in the body to output a signal corresponding to a swing of the operating lever. The operating lever includes: a basal portion, disposed on a vertex of the first movable contact of the press switch; and an operating portion, projecting outward from the body, being swingable in two opposite swing directions relative to the vertex serving as a fulcrum, and being depressible toward the press switch from at least one predetermined position on a swing path of the operating lever. The body includes a substantially arcuate abutting portion provided in a portion opposite the operating lever. The operating lever includes a protrusion, the protrusion protruding in a direction substantially orthogonal to the swing directions and being disposed above the abutting portion. The abutting portion of the body has at least one recess at a position thereof corresponding to the predetermined position. When the operating lever makes a depressing movement from a position other than the predetermined position, the protrusion abuts against the abutting portion. When the operating lever makes a depressing movement from the predetermined position, the protrusion is received in the recess of the abutting portion such that the basal portion presses the vertex of the first movable contact.

In the first compound operation input device configured as above, the protrusion of the operating lever abuts against the abutting portion of the body, thereby blocking depressing movement from a position other than the predetermined position on the swing path of the operating lever. Thus, it is possible to prevent input of erroneous depressing operation from a position other than the predetermined position on the swing path.

Moreover, the operating lever is swingable relative to the vertex of the first movable contact of the press switch with the vertex serving as a fulcrum. When the operating lever makes a depressing movement from the predetermined position on the swing path, the basal portion of the operating lever presses the vertex of the first movable contact. Accordingly, the predetermined position can be set at any chosen position on the swing path just by changing the position of the recess, obviating the need for repositioning a stationary contact for detecting a depressing movement of the operating lever in the body as in the conventional example. Therefore, the input device of the invention is highly versatile and applicable to various electronics.

Further general versatility for various electronics can be obtained in that the input device is adapted for depressing operations from a plurality of predetermined positions on the swing path just by providing in the abutting portion a plurality of recesses. Furthermore, even when the device is adapted for depressing operations from a plurality of predetermined positions on the swing path, the depressing operations can be detected with a single press switch. Hence, the input device may have a simplified internal structure, compared to a case of providing in the body a plurality of stationary contacts corresponding to the respective depressing movements from the plurality of predetermined positions.

In the case where the first compound operation input device further includes a pressing member, the basal portion of the operating lever being disposed on the pressing member instead of the press switch, it is preferable that the operating lever be adapted to make a depressing movement not toward the press switch but toward the pressing member. Upon depression of the pressing member by the basal portion in response to a depressing movement of the operating lever, the pressing member may be moved in a direction substantially orthogonal to the direction of the depressing movement and to the swing directions. The press switch may be disposed to oppose the pressing member with the vertex of the first movable contact pointing in an opposite direction to the moving direction of the pressing member.

In the first compound operation input device configured as above, the basal portion of the operating lever is disposed on the pressing member, and the press switch is disposed to oppose the pressing member with the vertex of the first movable contact pointing in an opposite direction to the moving direction of the pressing member. Therefore, upon being pressed by the basal portion of the operating lever, the pressing member moves in the moving direction to press the vertex of the first movable contact. The press switch depressible via the pressing member can be suitably pressed through a depressing movement of the operating lever, even when the press switch and the pressing member are arranged in line in the moving direction on the side to which the operating lever is depressed in order to avoid increase in thickness of the device. Furthermore, the pressing member can support the basal portion of the operating lever in a stable manner.

The press switch may include: first, second and third stationary contacts provided at the body; the first movable contact contacting the first stationary contact; and a second movable contact in a substantially arcuate cross-sectional shape.

The second movable contact may be disposed between the first movable contact and the body to be contactable with the second stationary contact. A vertex of The second movable contact may be located at a position between the vertex of the first movable contact and the third stationary contact. The operating lever may be capable of making a first depressing movement, in which the basal portion presses the vertex of the first movable contact directly or through the intermediary of the pressing member, and a second depressing movement, in which the basal portion presses the vertices of the first and second movable contacts directly or through the intermediary of the pressing member. If the vertex of the first movable contact is pressed as a result of the first depressing movement of the operating lever, the first movable contact may be elastically deformed and the vertex of the first movable contact may contact the vertex of the second movable contact. If the vertices of the first and second movable contacts are pressed as a result of the second depressing movement of the operating lever, the first and second movable contacts may be elastically deformed and the vertices of the first and second movable contacts may contact the third stationary contact.

As such, the first depressing movement of the operating lever brings the vertex of the first movable contact into contact with the vertex of the second movable contact, so that a signal indicating the first depressing movement is outputted, whilst the second depressing movement of the operating lever brings the vertices of the first and second movable contacts into contact with the third stationary contact, so that a signal indicating the second depressing movement is outputted. This configuration can widen the variation of operation inputs in comparison with a case in which the press switch has only one movable contact. Thus, the configuration advantageously promotes the versatility of the first compound operation input device.

The protrusion and the abutting portion may be separated by such a distance that, when the operating lever makes the first depressing movement from a position other than the predetermined position, the protrusion does not abut against the abutting portion, and that when the operating lever makes the second depressing movement from a position other than the predetermined position, the protrusion abuts against the abutting portion.

In this case, if the operating lever is operated from a position other than the predetermined position for the first depressing movement, the protrusion does not abut against the abutting portion, so that the basal portion of the operating lever or the pressing member presses the vertex of the first movable contact into contact with the vertex of the second movable contact. On the other hand, if the operating lever is operated from a position other than the predetermined position for the second depressing movement, the protrusion abuts against the abutting portion, whereby the second depressing movement is blocked. In other words, the operating lever in an swung state can make the first depressing movement but cannot make the second depressing movement. Such configuration can further widen the variation of operation inputs and thus advantageously promotes the versatility of the first compound operation input device.

In the case where the predetermined position includes at least first and second predetermined positions, from which the operating lever is depressible, it is preferable that the recess include at least first and second recesses that are located corresponding to the first and second predetermined positions, respectively, in the abutting portion of the body. It is further preferable that the first recess have such a depth that, when the operating lever makes the first depressing movement from the first predetermined position, the protrusion does not abut against a bottom of the first recess in the abutting portion, and that when the operating lever makes the second depressing movement from the first predetermined position, the protrusion abuts against the bottom of the first recess in the abutting portion. It is also preferable that the second recess have such a depth that, when the operating lever makes the first and second depressing movements from the second predetermined position, the protrusion does not abut against a bottom of the second recess in the abutting portion during both of the movements.

In this case, if the operating lever is operated from the first predetermined position for the first depressing movement, the protrusion is received in the first recess of the abutting portion without abutting against the bottom of the recess, so that the basal portion of the operating lever or the pressing member presses the vertex of the first movable contact into contact with the vertex of the second movable contact. If the operating lever is operated from the first predetermined position for the second depressing movement, the protrusion is received in the first recess of the abutting portion and abuts against the bottom portion of the recess, so that the second depressing movement is blocked. On the other hand, if the operating lever is operated from the second predetermined position for the first depressing movement, the protrusion is received in the second recess of the abutting portion without abutting against the bottom of the recess, so that the basal portion of the operating lever or the pressing member presses the vertex of the first movable contact into contact with the vertex of the second movable contact. If the operating lever is operated from the second predetermined position for the second depressing movement, the protrusion is received in the second recess of the abutting portion without abutting against the bottom of the recess, so that the basal portion of the operating lever or the pressing member presses the vertices of the first and second movable contacts into contact with the third stationary contact. That is, the operating lever can make the first depressing movement from the first predetermined position on the swing path of the operating lever but cannot make the second depressing movement therefrom, while the operating lever can make the first and second depressing movements from the second predetermined position on the swing path of the operating lever. Such configuration can further widen the variation of operation inputs and thus advantageously promotes the versatility of the first compound operation input device.

A second compound operation input device according to the present invention includes: a body; a press switch disposed in the body, the press switch including a first movable contact in a substantially arcuate cross-sectional shape; an operating lever; and a movement detecting part, disposed in the body to output a signal corresponding to a swing of the operating lever. The operating lever includes a basal portion, disposed on a vertex of the first movable contact of the press switch, and an operating portion, projecting outward from the body, being swingable in two opposite swing directions relative to the vertex serving as a fulcrum, and being depressible toward the press switch from at least one predetermined position on a swing path of the operating lever. The body includes an abutting portion in a substantially arcuate ledge shape, the abutting portion being arranged to face and project toward the operating lever. The operating lever includes a cutout, the cutout facing the body for receiving the abutting portion. The abutting portion of the body having at least one recess at a position thereof corresponding to the predetermined position. When the operating lever makes a depressing movement from a position other than the predetermined position, an upper lip of the cutout abuts against the abutting portion. When the operating lever makes a depressing movement from the predetermined position, the upper lip of the cutout is received in the recess of the abutting portion in such a manner that the basal portion presses the vertex of the first movable contact.

In the second compound operation input device configured as above, it is possible to prevent depressing movement from a position other than the predetermined position on the swing path of the operating lever by abutting the upper lip of the cutout in the operating lever against the abutting portion of the body. Hence, it is possible to prevent input of an erroneous depressing operation from a position other than the predetermined position on the swing path.

Moreover, the operating lever is swingable relative to the vertex of the first movable contact of the press switch with the vertex serving as a fulcrum. When the operating lever makes a depressing movement from the predetermined position on the swing path, the basal portion presses the vertex of the first movable contact. Accordingly, the predetermined position can be set at any chosen position on the swing path just by changing the position of the recess, obviating the need for repositioning a stationary contact for detecting a depressing movement of the operating lever in the body as in the conventional example. Therefore, the input device of the invention is highly versatile and applicable to various electronics.

Further general versatility for various electronics can be obtained in that the input device is adapted for depressing operations from a plurality of predetermined positions on the swing path just by providing in the abutting portion a plurality of recesses. Furthermore, even when the device is adapted for depressing operations from a plurality of predetermined positions on the swing path, the depressing operations can be detected with a single press switch. Hence, the input device may have a simplified internal structure, compared to a case of providing in the body a plurality of stationary contacts corresponding to the respective depressing movements from the plurality of predetermined positions.

The second compound operation input device may further include a pressing member, the basal portion of the operating lever being disposed on the pressing member instead of the press switch. In this case, it is preferable that the operating lever be adapted to make a depressing movement not toward the press switch but toward the pressing member. Upon depression of the pressing member by the basal portion in response to a depressing movement of the operating lever, the pressing member may be moved in a direction substantially orthogonal to the direction of the depressing movement and to the swing directions. The press switch may be disposed to oppose the pressing member with the vertex of the first movable contact pointing in an opposite direction to the moving direction of the pressing member.

In the second compound operation input device configured as above, the basal portion of the operating lever is disposed on the pressing member, and the press switch is disposed to oppose the pressing member with the vertex of the first movable contact pointing in an opposite direction to the moving direction of the pressing member. Therefore, upon being pressed by the basal portion of the operating lever, the pressing member moves in the moving direction to press the vertex of the first movable contact. The press switch depressible via the pressing member can be suitably pressed through a depressing movement of the operating lever, even when the press switch and the pressing member are arranged in line in the moving direction on the side to which the operating lever is depressed in order to avoid increase in thickness of the device. Furthermore, the pressing member can support the basal portion of the operating lever in a stable manner.

The press switch may include first, second and third stationary contacts, provided in the body; the first movable contact, contacting the first stationary contact; and a second movable contact in a substantially arcuate cross-sectional shape. The second movable contact may be disposed between the first movable contact and the body to be contactable with the second stationary contact. A vertex of the second movable contact may be located at a position between the vertex of the first movable contact and the third stationary contact. The operating lever may be capable of making a first depressing movement, in which the basal portion presses the vertex of the first movable contact directly or through the intermediary of the pressing member, and a second depressing movement, in which the basal portion presses the vertices of the first and second movable contacts directly or through the intermediary of the pressing member. If the vertex of the first movable contact is pressed as a result of the first depressing movement of the operating lever, the first movable contact may be elastically deformed and the vertex of the first movable contact may contact the vertex of the second movable contact. If the vertices of the first and second movable contacts are pressed as a result of the second depressing movement of the operating lever, the first and second movable contacts may be elastically deformed and the vertices of the first and second movable contacts contact the third stationary contact.

As such, the first depressing movement of the operating lever brings the vertex of the first movable contact into contact with the vertex of the second movable contact, so that a signal indicating the first depressing movement is outputted, whilst the second depressing movement of the operating lever brings the vertices of the first and second movable contacts into contact with the third stationary contact, so that a signal indicating the second depressing movement is outputted. This configuration can widen the variation of operation inputs in comparison with a case in which the press switch has only one movable contact. Thus, the configuration advantageously promotes the versatility of the first compound operation input device.

The upper lip of the cutout and the abutting portion may be separated by such a distance that, when the operating lever makes the first depressing movement from a position other than the predetermined position, the upper lip does not abut against the abutting portion, and that when the operating lever makes the second depressing movement from a position other than the predetermined position, the upper lip abuts against the abutting portion.

In this case, when the operating lever is operated from a position other than the predetermined position for the first depressing movement, the upper lip does not abut against the abutting portion, so that the basal portion of the operating lever or the pressing member presses the vertex of the first movable contact into contact with the vertex of the second movable contact. On the other hand, if the operating lever is operated from a position other than the predetermined position for the second depressing movement, the upper lip abuts against the abutting portion, whereby the second depressing movement is blocked. In other words, the operating lever in an swung state can make the first depressing movement but cannot make the second depressing movement. Such configuration can further widen the variation of operation inputs and thus advantageously promotes the versatility of the second compound operation input device.

The second compound operation input device may have such a structure that the predetermined position includes at least first and second predetermined positions, from which the operating lever is depressible. In this case, it is preferable the recess include at least first and second recesses that are located corresponding to the first and second predetermined positions, respectively, in the abutting portion of the body. It is further preferable that the first recess have such a depth that, when the operating lever makes the first depressing movement from the first predetermined position, the upper lip of the cutout does not abut against a bottom of the first recess in the abutting portion, and that when the operating lever makes the second depressing movement from the first predetermined position, the upper lip of the cutout abuts against the bottom of the first recess in the abutting portion. It is also preferable that the second recess have such a depth that, when the operating lever makes the first and second depressing movements from the second predetermined position, the upper lip of the cutout does not abut against a bottom of the second recess in the abutting portion during both of the movements.

In this case, if the operating lever is operated from the first predetermined position for the first depressing movement, the upper lip is received in the first recess of the abutting portion without abutting against the bottom of the recess, so that the basal portion of the operating lever or the pressing member presses the vertex of the first movable contact into contact with the vertex of the second movable contact. If the operating lever is operated from the first predetermined position for the second depressing movement, the upper lip is received in the first recess of the abutting portion and abuts against the bottom portion of the recess, so that the second depressing movement is blocked. On the other hand, if the operating lever is operated from the second predetermined position for the first depressing movement, the upper lip is received in the second recess of the abutting portion without abutting against the bottom of the recess, so that the basal portion of the operating lever or the pressing member presses the vertex of the first movable contact into contact with the vertex of the second movable contact. If the operating lever is operated from the second predetermined position for the second depressing movement, the upper lip is received in the second recess of the abutting portion without abutting against the bottom of the recess, so that the basal portion of the operating lever or the pressing member presses the vertices of the first and second movable contacts into contact with the third stationary contact. That is, the operating lever can make the first depressing movement from the first predetermined position on the swing path of the operating lever but cannot make the second depressing movement therefrom, while the operating lever can make the first and second depressing movements from the second predetermined position on the swing path of the operating lever. Such configuration can further widen the variation of operation inputs and thus advantageously promotes the versatility of the first compound operation input device.

It is preferable that at least one of the basal portion of the operating lever and the pressing member has a slope for moving the pressing member toward the press switch upon depression of the operating lever. In this case, the slope eases movement of the pressing member when the operating lever is depressed.

In the case where the pressing member is elastically deformable, when the first movable contact is released from pressure by the operating lever, the pressing member and the first movable contact are preferably restorable so as to lift the operating lever. In this case, the depressed operating lever can be returned to the predetermined position by means of the pressing member and the first movable contact, producing an advantageous effect in simplifying the internal structure of the device.

Alternatively, if the pressing member is elastically deformable, when the first movable contact is released from pressure directly by the operating lever, the first movable contact is preferably restorable so as to lift the operating lever; and when the first and second movable contacts are released from pressure directly by the operating lever, the first and second movable contacts are preferably restorable so as to lift the operating lever. If the first movable contact is released from pressure through the intermediary of the pressing member, instead of release from direct pressure by the operating lever, the pressing member and the first movable contact are preferably restorable so as to lift the operating lever; and when the first and second movable contacts are released from pressure through the intermediary of the pressing member, the pressing member and the first and second movable contacts are preferably restorable so as to lift the operating lever. In either of the above cases, the depressed operating lever can be returned to the predetermined position by means of the first and second movable contacts or by means of the pressing member and the first and second movable contacts, producing an advantageous effect in simplifying the internal structure of the device.

BRIEF DESCRIPTION OF THE DRAWINGS

FIG. 1A is a front view with a cover removed, FIG. 1B is a rear view, and FIG. 1C is a side view;

FIG. 5A is a set of front and rear views simultaneously showing a state in which an operating lever is at a predetermined position, FIG. 5B is a set of front and rear views simultaneously showing a state in which the operating lever has made a first depressing movement, and FIG. 5C is a set of front and rear views simultaneously showing a state in which the operating lever has made a second depressing movement;

FIG. 7A shows a state in which the press switch is not pressed yet, FIG. 7B shows a first-phase pressed state of the press switch, and FIG. 7C shows a second-phase pressed state of the press switch;

FIG. 9A shows a state before depressing operation, FIG. 9B shows a state in which a first depressing movement is made, and FIG. 9C shows a state in which a second depressing movement is made;

FIG. 10A shows a state in which the operating lever of the device is inclined and FIG. 10B shows a state in which the operating lever in the inclined state of the device has made the first depressing movement;

FIG. 11A is a rear view of the modified device, FIG. 11B is a front view of a body thereof, and FIG. 11C is a rear view of an operating lever thereof;

FIG. 12A is a rear view of the modified device, FIG. 12B is a front view of a body thereof, and FIG. 12C is a rear view of an operating lever thereof;

FIG. 13A shows an example in which a plurality of recesses in the ledge have the same shape and FIG. 13B shows an example in which some of the plurality of recesses in the ledge are different in shape from the others;

FIG. 14A shows a state in which the operating lever is at a predetermined position and FIG. 14B shows a state in which the operating lever is swung; FIG. 15A shows a state in which the operating lever is at a predetermined position and FIG. 15B shows a state in which the operating lever is swung.

DETAILED DESCRIPTION OF THE PREFERRED EMBODIMENTS

Embodiments of a compound operation input device according to the present invention are described below.

First Embodiment

Figure 1:
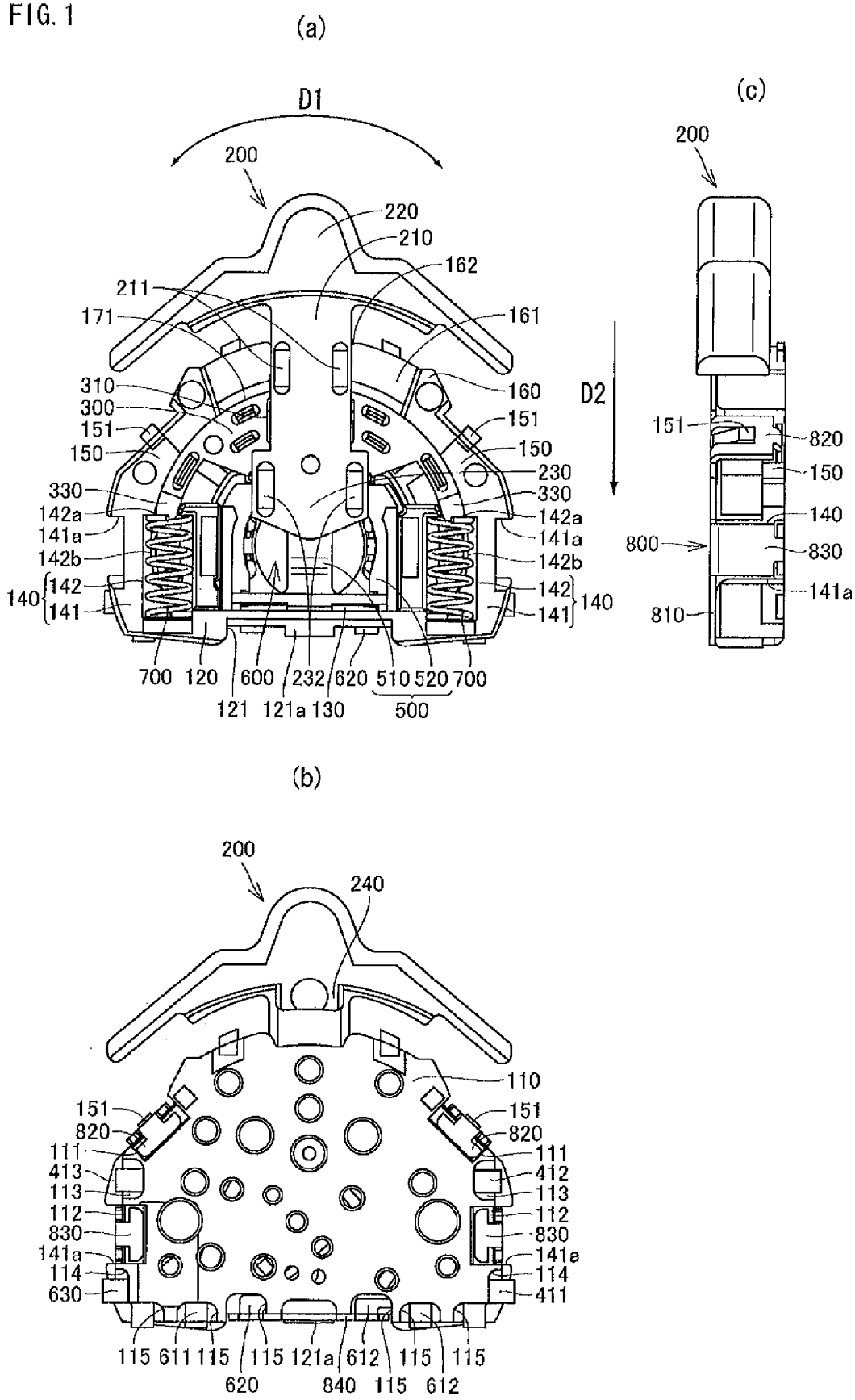
FIGS. 1A to 1C are schematic views showing a compound operation input device according to a first embodiment of the present invention, where
Figure 2:
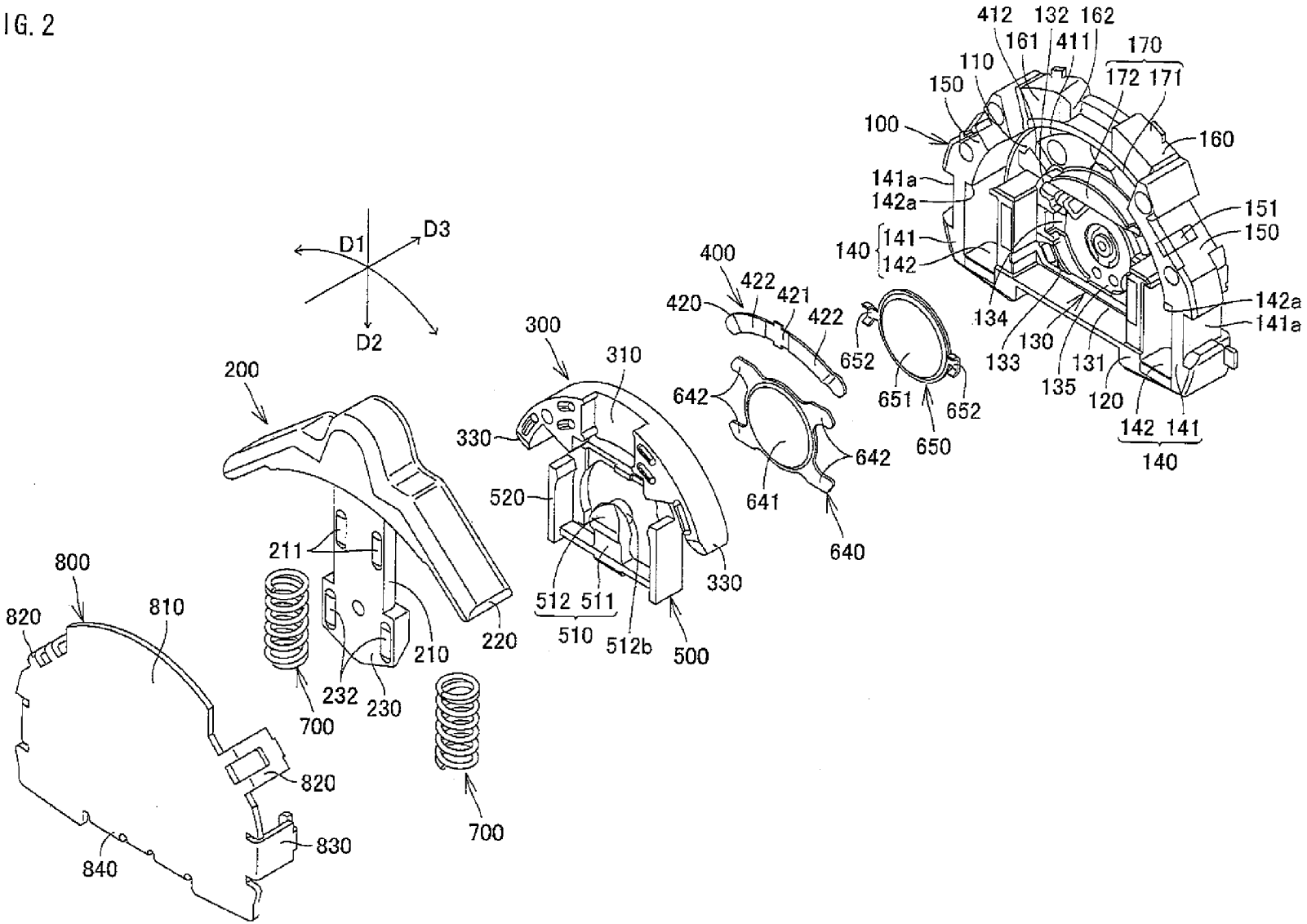
FIG. 2 is an exploded perspective view of the device as viewed from the upper front side thereof.
Figure 3:
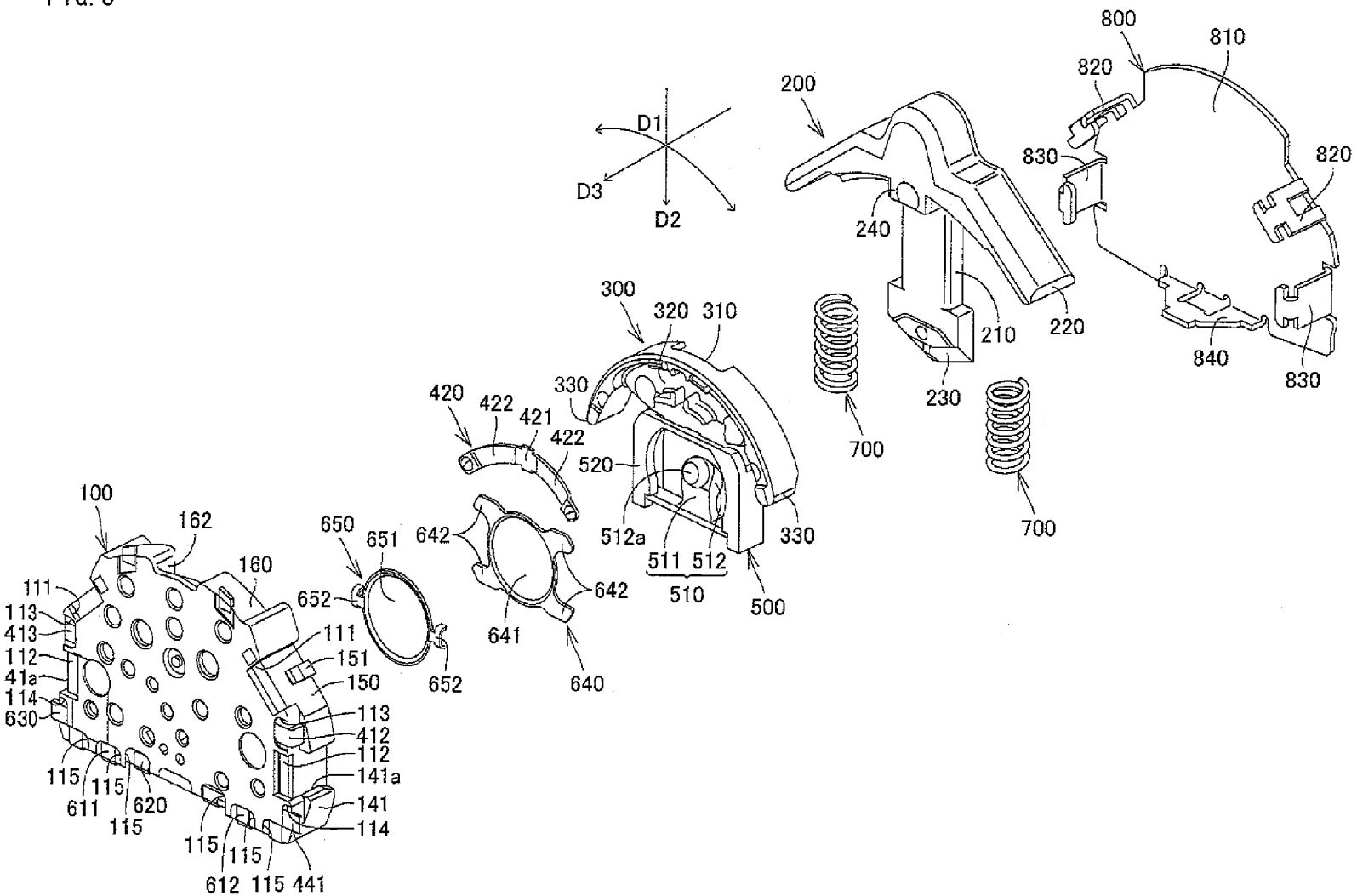
FIG. 3 is an exploded perspective view of the device as viewed from the upper rear side thereof.
Figure 4:
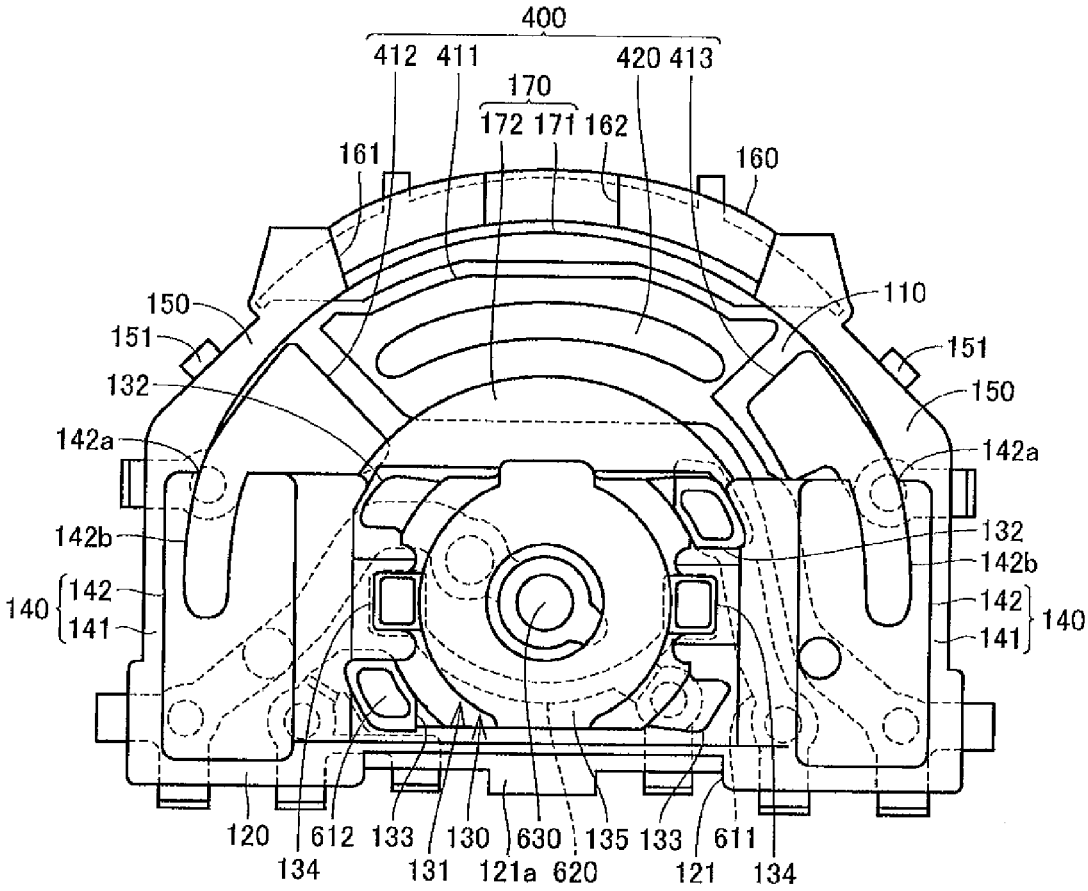
FIG. 4 is a schematic illustration of a body of the device, showing exposed portions of stationary contacts of a press switch as well as of contacts of a movement detecting part.
Figure 5:
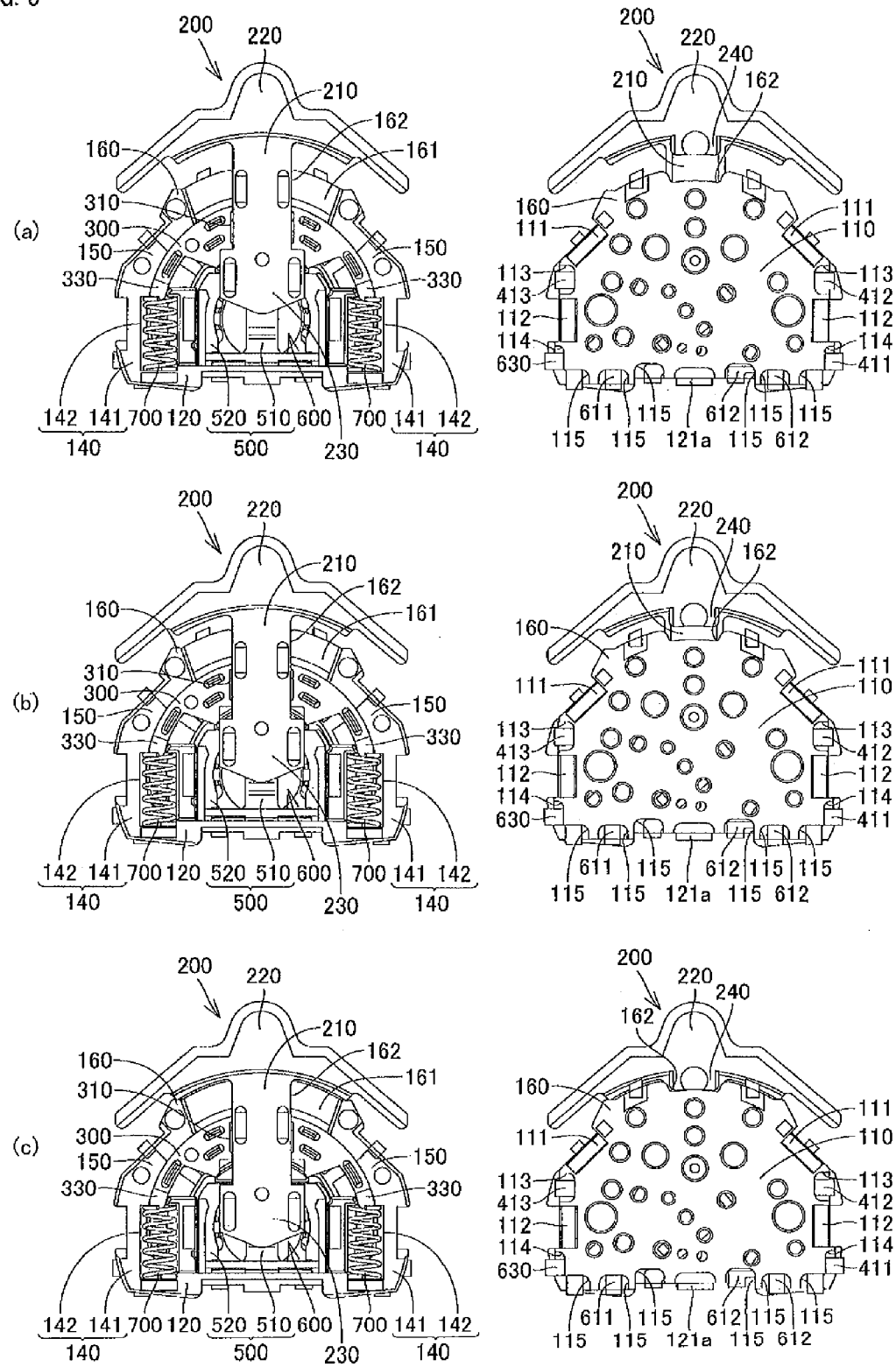
FIGS. 5A to 5C are schematic views showing the device with the cover removed, where
Figure 6:
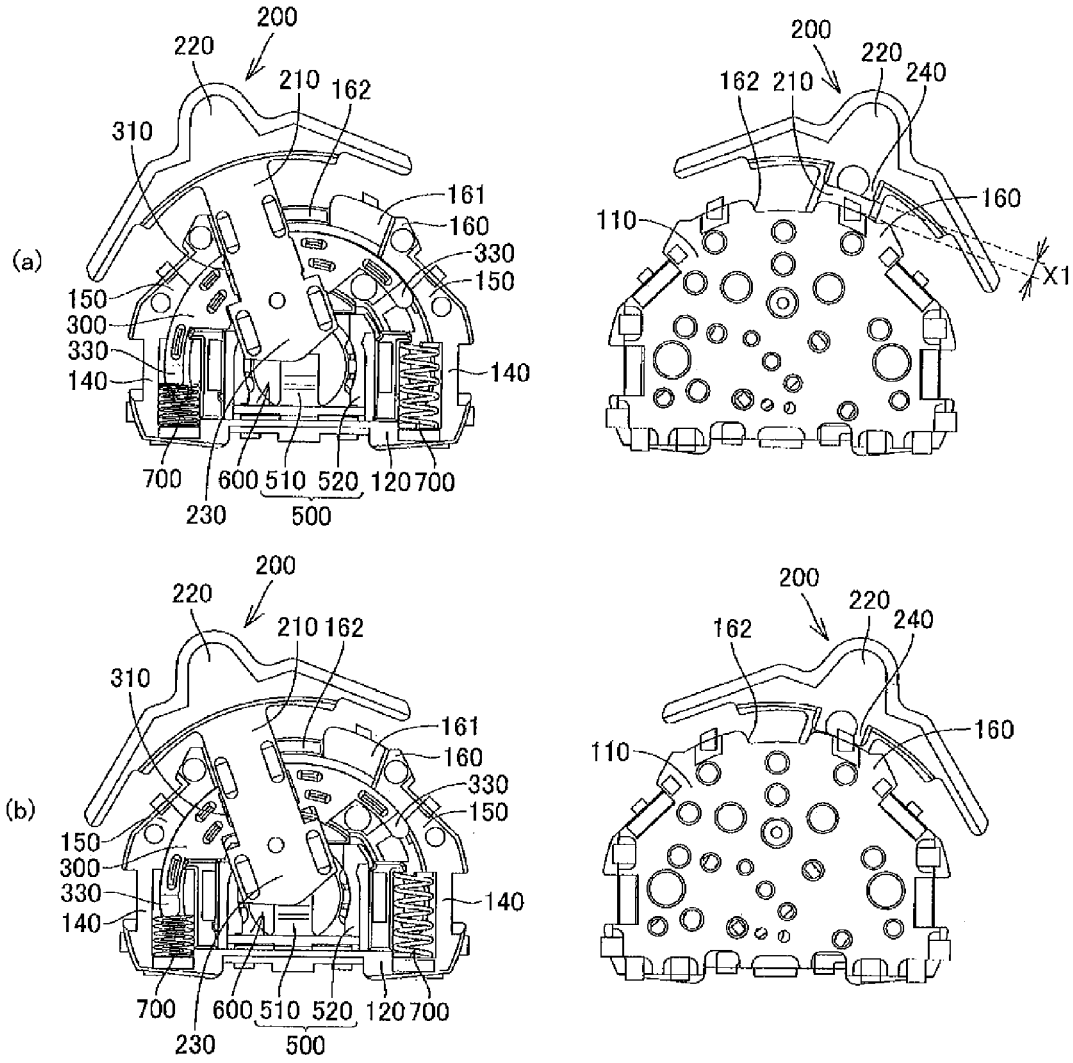
FIG. 6A is a set of schematic front and rear views of the device with the cover removed, simultaneously showing a state in which the operating lever is inclined.
FIG. 6B is a set of schematic front and rear views of the device with the cover removed, simultaneously showing a state in which the operating lever has made the first depressing movement while in the inclined state.
Figure 7:
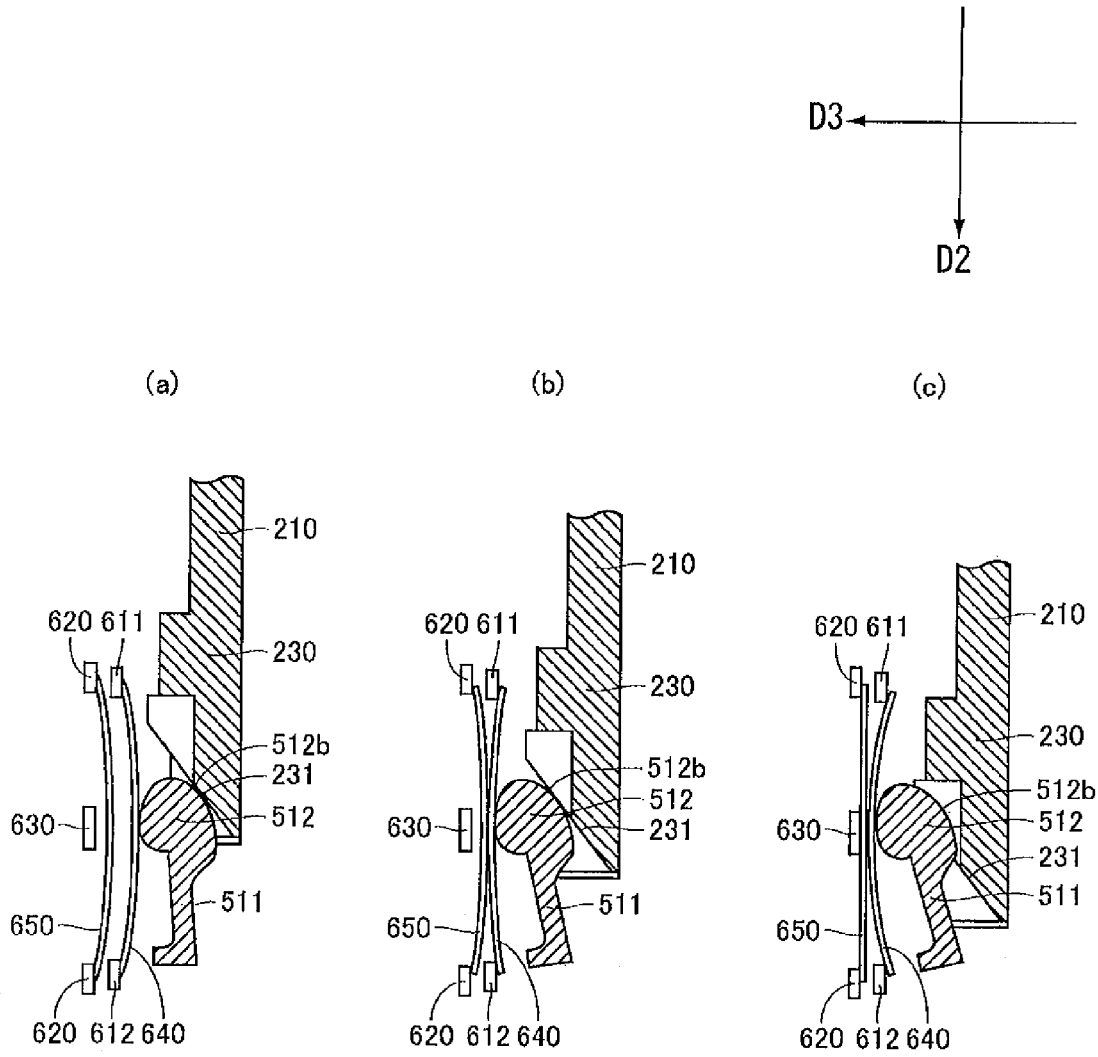
FIGS. 7A to 7C are schematic cross-sectional illustrations of a basal portion of the operating lever, a pressing member main body, and the press switch of the device, where

First, a compound operation input device according to a first embodiment of the present invention is described with reference to FIGS. 1 to 7. FIGS. 1A to 1C are schematic views showing the compound operation input device according to the first embodiment of the present invention, where FIG. 1A is a front view with a cover removed, FIG. 1B is a rear view, and FIG. 1C is a side view. FIG. 2 is an exploded perspective view of the device as viewed from the upper front side thereof. FIG. 3 is an exploded perspective view of the device as viewed from the upper rear side thereof. FIG. 4 is a schematic illustration of a body of the device, showing exposed portions of stationary contacts of a press switch and of contacts of a movement detecting part. FIGS. 5A to 5C are schematic views showing the device with the cover removed, where FIG. 5A is a set of front and rear views simultaneously showing a state in which an operating lever is at a predetermined position, FIG. 5B is a set of front and rear views simultaneously showing a state in which the operating lever has made a first depressing movement, and FIG. 5C is a set of front and rear views simultaneously showing a state in which the operating lever has made a second depressing movement. FIG. 6A is a set of schematic front and rear views of the device with the cover removed, simultaneously showing a state in which the operating lever is inclined, and FIG. 6B is a set of schematic front and rear views of the device with the cover removed, simultaneously showing a state in which the operating lever has made the first depressing movement while in the inclined state. FIGS. 7A to 7C are schematic cross-sectional illustrations of a basal portion of the operating lever, a pressing member main body, and the press switch of the device, where FIG. 7A shows a state in which the press switch is not pressed yet, FIG. 7B shows a first-phase pressed state of the press switch, and FIG. 7C shows a second-phase pressed state of the press switch.

The compound operation input device shown in FIGS. 1A to 4 includes a body 100, an operating lever 200, a substantially arcuate rotor 300, a movement detecting part 400, a pressing member 500, a press switch 600, a pair of coil springs 700, and a frame ground 800. The operating lever 200 is held to the body 100 in such a manner as to be swingable in two opposite swing directions D1 from a predetermined position and to be depressible downward (depressing movement direction D2) from the predetermined position to make two-phased, first and second depressing movements. The operating lever 200 is attached to the rotor 300 in a vertically movable manner, and the rotor 300 swings together with the operating lever 200. The movement detecting part 400 outputs signals in response to swings of the operating lever 200. The pressing member 500 is disposed below the operating lever 200 and includes a head 512 that is moved in response to a depressing movement of the operating lever 200. The head 512 of the pressing member 500 is pressed to bring the press switch 600 into a first phase switch-on or second phase switch-on state. The pair of coil springs 700 serves as a neutral position restoration mechanism that causes the swung operating lever 200 to return to the predetermined position. The frame ground 800 is attached to the body 100. Each part of the device is described in detail below.

As shown in FIGS. 1A to 1C, 2, 3, and 4, the body 100 is an injection-molded article made of resin. The body 100 includes a plate-like base 110 substantially in a pentagonal shape with a round top, a bottom wall 120 that stands on a lower periphery of the inner surface of the base 110, a switch housing portion 130 provided in the center of the inner surface of the base 110, a pair of spring housings 140 provided at either side of the inner surface of the base 110, two inclined walls 150 that stand on inclined edges of the inner surface of the base 110, an arcuate wall 160 (an abutting portion) that stands on an upper edge of the inner surface of the base 110, and a guide 170 for guiding the rotor 300 to swingably move in the same directions as the operating lever 200.

As shown in FIGS. 1A to 3, the bottom wall 120 has a recess 121 in its lower center. Provided in the recess 121 is an locking projection 121*a* for locking a lower locking piece 840 of the frame ground 800.

The spring housings 140 each include a substantially rectangular prism portion 141 and a housing recess 142. The prism portions 141 are provided continuously from and substantially orthogonally to the outer ends of the bottom wall 120. The housing recesses 142 are provided in respective central portions of the prism portions 141 to house the coil springs 700.

The outer walls of the prism portions 141 constitute sidewalls of the body 100. Provided on the outer walls of the prism portions 141 are locking recesses 141*a* for receiving lateral locking pieces 830 of the frame ground 800.

The housing recesses 142 have openings 142*a* at their respective upper centers. Substantially arcuate guide grooves 142*b* communicating with the openings 142*a* are provided at the respective upper centers of the innermost surfaces of the housing recesses 142. Arms 330 of the rotor 300 are movably fitted in the guide grooves 142*b*.

As shown in FIGS. 1A to 3, the inclined walls 150 have locking projections 151 on their outer surfaces to lock upper locking pieces 820 of the frame ground 800.

The outer surface of the base 110 is used for implementation on a circuit board of an electronic device. As shown in FIGS. 1B and 3, two upper housing recesses 111 are provided on the respective rear sides of the inclined walls 150 on the outer surface of the base 110 so as to house connecting pieces of the upper locking pieces 820 of the frame ground 800. Solder is injected into the upper housing recesses 111, whereby the connecting pieces of the upper locking pieces 820 of the frame ground 800 are connected to the circuit board.

The base 110 further has two lateral housing recesses 112 on the outer surface of the base 110, more specifically, on the respective backsides of the spring housings 140. These recesses 112 communicate with the two locking recesses 141*a* to house connecting pieces of the lateral locking pieces 830 of the frame ground 800. Solder is injected into the lateral housing recesses 112 so that the connecting pieces of the lateral locking pieces 830 of the frame ground 800 are connected to the circuit board.

Provided between the upper housing recesses 111 and the lateral housing recesses 112 on the outer surface of the base 110 are two first lateral lead-out recesses 113 to lead out respective second ends of contacts 412 and 413 of the movement detecting part 400 onto the outer surface of the base 110. Solder is injected into the first lateral lead-out recesses 113 so that the second ends of the contacts 412 and 413 are connected to the circuit board.

Provided below the lateral housing recesses 112 on the outer surface of the base 110 are two second lateral lead-out recesses 114 to lead out respective second ends of a contact 411 of the movement detecting part 400 and of a third stationary contact 630 of the press switch 600 onto the outer surface of the base 110. Solder is injected into the second lateral lead-out recesses 114 so that the second ends of the contact 411 and the third stationary contact 630 are connected to the circuit board.

Provided along the lower edge of the outer surface of the base 110 are six lower lead-out recesses 115 to lead out respective second ends of first stationary contacts 611 and 612 and of a second stationary contact 620 of the press switch 600 onto the outer surface of the base 110. Solder is injected into the lower lead-out recesses 115 so that the second ends of the first and second stationary contacts 611, 612, and 620 are connected to the circuit board.

As shown in FIGS. 1A to 3, the arcuate wall 160 includes a substantially arcuate guide recess 161 and a recess 162. The guide recess 161 extends vertically through a central portion of the inner surface of the arcuate wall 160. The recess 162 is provided at the innermost surface of the guide recess 161 and is opened upwardly.

A shaft 210 of the operating lever 200 is swingably received at its upper end in the guide recess 161. The lateral edges of the guide recess 161 define the swing range of the shaft 210 of the operating lever 200.

The recess 162 communicates with the guide recess 161 and is adapted to receive a protrusion 240 of the operating lever 200. When the protrusion 240 is received in the recess 162, the operating lever 200 can be depressed downward (in the direction D2) from a predetermined position to make a first depressing movement or a second depressing movement.

As shown in FIGS. 2 and 4, the guide 170 includes a guide surface 171 of substantially semi-circular arc shape and a substantially semi-columnar guide projection 172. The guide surface 171 is provided along interior surfaces of the inclined walls 150 and of the arcuate wall 160. The guide projection 172 is provided above the switch housing portion 130 on the inner surface of the base 110. The rotor 300 is swingably guided between the guide surface 171 and the guide projection 172.

As shown in FIGS. 2 and 4, the switch housing portion 130 includes a substantially rectangular housing main portion 131, two projecting first supporting portions 132, two projecting second supporting portions 133, two recessed third supporting portions 134, and a substantially circularly recessed contact placing portion 135. The housing main portion 131 is defined by the bottom wall 120, the prism portions 141 of the spring housings 140, and the guide projection 172. The first supporting portions 132 are provided at opposite upper corners of the innermost portion of the housing main portion 131. The second supporting portions 133 are provided at opposite lower corners of the same innermost portion, while the third supporting portions 134 are provided between the first supporting portion 132 and the second supporting portion 133. The contact placing portion 135 is formed centrally in the switch housing portion 130.

The first and second supporting portions 132 and 133 have recesses for holding first legs 642 of a first movable contact 640.

The third supporting portions 134 hold second legs 652 of a second movable contact 650.

As shown in FIGS. 1A to 3, the operating lever 200 includes the elongated plate-like shaft 210, a substantially arcuate operating arm 220 (operating portion) provided at the upper end of the shaft 210, a plate-like basal portion 230 shaped like a baseball home plate and provided at the lower end of the shaft 210, and the protrusion 240. The protrusion 240 protrudes outwardly (i.e., in a direction D3 substantially orthogonal to the swing directions D1) from the backside of the upper end of the shaft 210.

The lower end of the shaft 210 fits in a fitting recess 310 of the rotor 300 in a vertically movable manner. The upper end of the shaft 210 sticks out of the body 100 past its guide recess 161.

Wider than the shaft 210, the basal portion 230 have shoulders toward the top abuttable against the lower ends of the lateral edges of the fitting recess 310 of the rotor 300. The operating lever 200 is thereby prevented from coming off upward.

As shown in FIGS. 7A to 7C, a recess is provided at the lower end of the basal portion 230 to contain the head 512 of the pressing member 500. The head 512 fitted in the recess serves as a fulcrum to support the operating lever 200 swingably from the predetermined position in the swing directions D1.

The innermost bottom of the recess forms a slope 231, which gets thicker upward. The slope 231 presses on a supporting portion 512*b* of the head 512 of the pressing member 500 in response to a depressing movement (movement in the downward direction D2) of the operating lever 200, whereby an axial support 511 of the pressing member 500 becomes inclined and the head 512 moves onto the press switch 600 (in the movement direction D3). The head 512 presses the press switch 600 through this movement.

The first depressing movement means depressing movement of the operating lever 200 for causing the head 512 to press a vertex of the first movable contact 640 of the press switch 600. The second depressing movement means depressing movement of the operating lever 200 for causing the head 512 to press vertices of the first and second movable contacts 640 and 650 of the press switch 600. These depressing movements will be described more in detail below.

Two projections 211 are provided on the front of the shaft 210, and two projections 232 are provided on the front of the basal portion 230. These projections 211 and 232 abut a base plate 810 of the frame ground 800.

The protrusion 240 is inserted into the recess 162 of the arcuate wall 160 in accordance of the second depressing movement of the operating lever 200. Before depressing movement, the protrusion 240 is located at the position shown in FIG. 5A (the position is hereinafter referred to as an initial position), with the lower end of the basal portion 230 supported at the predetermined position on the head 512 of the pressing member 500. When the operating lever 200 is swung (i.e., when at any position other than the predetermined position on its swing path), the distance X1 between the protrusion 240 and either outside edge of the recess 162 in the arcuate wall 160 is set such that, as shown in FIG. 6A, the protrusion 240 does not abut against either outside edge when the operating lever 200 makes the first depressing movement from the position on the swing path, and that the protrusion 240 abuts against the outside edge when the operating lever 200 makes the second depressing movement from the position on the swing path.

As shown in FIG. 1A, the rotor 300 is a substantially arcuate injection-molded article made of plastic material. It is swingably guided between the guide surface 171 and the guide projection 172 of the body 100. As shown in FIG. 2, the fitting recess 310 is provided centrally on the front side of the rotor 300 to receive the shaft 210 of the operating lever 200 in a vertically movable manner. When the operating lever 200 swings and its shaft 210 presses either lateral edge of the fitting recess 310, the rotor 300 is swung accordingly.

The side faces of the fitting recess 310 are depressed in the middle to reduce friction caused by the vertically moving shaft 210.

As shown in FIG. 3, an attaching recess 320 is provided on the rear side of the rotor 300 to attach a brush 420 of the movement detection part 400.

The substantially arcuate paired arms 330 are provided on respective lateral ends of the rotor 300. The arms 330 are inserted into the openings 142*a* of the spring housings 140 to abut the respective coil springs 700 in the housing recesses 142. The rotor 300 is thus held at the center of the guide 170 while the operating lever 200 is held substantially upright. The operating lever 200 at the predetermined position is set substantially upright and borne on the pressing member 500 as described above.

The arms 330 enter the housing recesses 142 along the guide grooves 142*b* in the housing recesses 142, in accordance with swing of the rotor 300, to compress the springs 700. The compression provides force in the returning direction.

As shown in FIGS. 2 and 4, the movement detecting part 400 includes the contacts 411, 412, and 413, embedded in the base 110 of the body 100, and the brush 420 to selectively contact the contacts 411, 412, and 413.

A first end of the contact 411 is exposed in the center of an area between the guide surface 171 and the guide projection 172 on the inner surface of the base 110. As shown in FIG. 1B, a second end of the contact 411 is exposed on the outer surface of the base 110 past the second lateral lead-out recesses 114 in the base 110.

First ends of the contacts 412 and 413 are exposed on each side of the contact 411 disposed between the guide surface 171 and the guide projection 172 on the inner surface of the base 110. As shown in FIG. 1B, second ends of the contacts 412 and 413 are exposed on the outer surface of the base 110 past the first lateral lead-out recesses 113 in the base 110.

The brush 420 is a substantially arcuate conductive plate. It includes a main body 421, which is to fit in the attaching recess 320 in the rotor 300, and two contacting arms 422 continuous from the opposite ends of the main body 421.

The contacting arms 422 are bent at their tips toward the base 110. The tips slide on the surface between the guide surface 171 and the guide projection 172 of the base 110 in accordance with swing of the rotor 300 to selectively contact the first ends of the contacts 411, 412, or 413. The movement detecting part 400 thereby outputs signals indicating a swing of the operating lever 200 to the electronic device.

As shown in FIGS. 2 to 4, the press switch 600 includes the first stationary contacts 611 and 612, the second stationary contact 620, the third stationary contact 630, the first movable contact 640 to contact the first stationary contacts 611 and 612, and the second movable contact 650 disposed between the switch housing portion 130 of the body 100 and the first movable contact 640 to contact the second stationary contact 620. The first, second and third stationary contacts 611, 612, 620 and 630 are embedded in the base 110 of the body 100.

The second stationary contact 620 is bifurcated at its first end, and the bifurcated ends are exposed on the respective innermost surfaces of recessed third supporting portions 134 of the switch housing portion 130. A second end of the second stationary contact 620 projects downward from one of the lower lead-out recesses 115 in the base 110 and is bent in a substantially L-shape along the bottom surface of the recess 121 in the bottom wall 120.

A first end of the first stationary contact 611 is exposed on the innermost surface of the recess of one of the first supporting portions 132. A second end of the first stationary contact 611 projects downward from another lower lead-out recess 115 in the base 110 and is bent in a substantially L-shape along the lower surface of the bottom wall 120.

A first end of the first stationary contact 612 is exposed on the innermost surface of the recess of the other second supporting portions 133. A second end of the first stationary contact 612 projects downward from another lower lead-out recess 115 in the base 110 and is bent in a substantially L-shape along the lower surface of the bottom wall 120.

A first end of the third stationary contact 630 is exposed centrally of the contact placing portion 135. A second end of the third stationary contact 630 projects laterally from one of the second lateral lead-out recesses 114 in the base 110 and is bent in a substantially L-shape along the outer wall of the corresponding prism portion 141.

The second movable contact 650 includes an elastically deformable second contact main body 651, which is substantially dome-shaped (i.e., substantially arcuate in cross section), and the two second legs 652, which are spaced at 180 degrees on the periphery of the second contact main body 651. The two second legs 652 fit in the paired third supporting portions 134 of the switch housing portion 130. In this state, the second contact main body 651 is set on the third supporting portions 134 of the switch housing portion 130 to contact the bifurcated first end portions of the second stationary contact 620. Simultaneously therewith, the vertex of the second contact main body 651 is disposed in front of the third stationary contact 630.

The second legs 652 are bent frontward at their ends. The bent width of the ends is substantially equal to the depth of the two third supporting portions 134.

As shown in FIGS. 2 and 3, the first movable contact 640 includes an elastically deformable first contact main body 641, which is substantially dome-shaped (i.e., substantially arcuate in cross section), and the four first legs 642, which are spaced at about ninety degrees on the periphery of the first contact main body 641.

The four first legs 642 fit in the recesses of the first and second supporting portions 132 and 133 in pairs of the switch housing portion 130. Two of the four first legs 642 thereby contact the respective first ends of the first stationary contacts 611 and 612. As a result, the first movable contact 640 is disposed over the second movable contact 650, while the vertex of the first contact main body 641 is disposed in the front of the vertex of the second contact main body 651.

The first legs 642 are elastically deformable. The tips of the first legs 642 are curved frontward. The tips are each of substantially equal thickness to each depth of the recesses of the first and second supporting portions 132 and 133.

With the four first legs 642 being held in the first and second supporting portions 132 and 133 in pairs of the switch housing portion 130, as shown in FIGS. 7A to 7C, the vertex of the first contact main body 641 is faced with the head 512 of the pressing member 500. The vertex is pointing opposite to the direction of movement of the pressing member 500.

Accordingly, when the first depressing movement of the operating lever 200 causes the head 512 of the pressing member 500 to press the vertex of the first contact main body 641, as shown in FIG. 7B, the four first legs 642 and the first contact main body 641 become elastically deformed, so that the vertex of the first contact main body 641 touches the vertex of the second contact main body 651. In this manner, the press switch 600 provides the first phase switch-on in response to the first depressing movement of the operating lever 200.

When the second depressing movement of the operating lever 200 causes the head 512 of the pressing member 500 to press the vertices of the first and second contact main bodies 641 and 651, as shown in FIG. 7C, the four first legs 642 and the first and second contact main bodies 641 and 651 become elastically deformed, so that the vertex of the first contact main body 641 contacts the first end of the third stationary contact 630 via the second contact main body 651. In this manner, the press switch 600 provides the second phase switch-on in response to the second depressing movement of the operating lever 200.

As shown in FIGS. 2, 3, and 7A to 7C, the pressing member 500 is a molded article made of plastic material, including a pressing member main body 510 and a frame 520 having the pressing member main body 510 therein.

The frame 520 is of a substantially rectangular shape that conforms to the shape defined by the inner walls of the housing main portion 131 so as to fit in the housing main portion 131. In the fitted state, both lateral ends of the frame 520 are placed on the first and second supporting portions 132, 133, and 134 on the innermost portion of the housing main portion 131. Accordingly, the tips of the first legs 642 of the first movable contact 640 and the lateral ends of the second legs 652 of the second movable contact 650 are held between the lateral ends of the frame 520 and the first and second supporting portions 132, 133 and 134, whereby the first and second movable contacts 640 and 650 are prevented from floating.

The upper end of the frame 520 is formed rodlike, allowing the basal portion 230 of the operating lever 200 to be set above the head 512 of the pressing member main body 510.

The pressing member main body 510 includes the plate-like axial support 511 at the lower end of the frame 520 and the head 512 at the tip of the axial support 511.

The head 512 has a pressing portion 512*a* and the supporting portion 512*b*. With the frame 520 fitted in the switch housing portion 130, the pressing portion 512*a* projects toward the vertex of the first movable contact 640 of the press switch 600 disposed inside the switch housing portion 130. The supporting portion 512*b*, provided on the opposite side of the pressing portion 512*a*, curves in a semi-circular arc shape and gradually enlarges downward.

The basal portion 230 of the operating lever 200 is placed on the supporting portion 512*b*. When the slope 231 of the basal portion 230 presses on the supporting portion 512*b*, the head 512 is moved onto the press switch 600 to press the vertex of the first contact main body 641 or the vertices of the first and second contact main bodies 641 and 651 of the press switch 600.

The axial support 511 is elastically deformable. When the slope 231 of the basal portion 230 presses on the supporting portion 512*b*, the axial support 511 becomes inclined toward the press switch 600 from its substantially upright position. This inclination causes the head 512 to move onto the press switch 600.

The frame ground 800 is formed of a metal plate. As shown in FIG. 3, the frame ground 800 includes the base plate 810 in a substantially pentagonal plate-like shape with a round top, the two upper locking pieces 820 on each side of the top of the base plate 810, the two lateral locking pieces 830 on opposite lateral ends of the base plate 810, and the lower locking piece 840 at the center of the lower end of the base plate 810.

The upper locking pieces 820 each have a rectangular plate and a connecting piece in a fan-like shape. The plates conform to the outer surfaces of the inclined walls 150 of the body 100. The connecting pieces are provided at the tips of the plates and bent at a substantially right angle to the plates. Locking holes are provided centrally of the plates to engage with the locking projections 151. The connecting pieces are housed in the upper housing recesses 111 of the base 110. That is, the locking projections 151 fit in the respective locking holes in the plates and the connecting pieces are housed in the upper housing recesses 111 of the base 110; whereby the upper locking pieces 820 are locked to the body 100.

The lateral locking pieces 830 each have a rectangular plate and a connecting piece in a fan-like shape. The plates fit in the locking recesses 141*a* of the body 100. The connecting pieces are provided at the tips of the plates and bent at a substantially right angle to the plates. The connecting pieces are housed in the lateral housing recesses 112 of the base 110. That is, the plates fit in the locking recesses 141*a* and the connecting pieces are housed in the lateral housing recesses 112 of the base 110, whereby the lateral locking pieces 830 are locked to the body 100.

The lower locking piece 840 is a substantially triangular plate to be housed in the recess 121 of the body 100 and has a locking hole in its center to engage with the locking projection 121*a*. That is, the locking projection 121*a* fits in the locking hole, whereby the lower locking piece 840 is locked to the bottom surface of the recess 121 of the body 100.

With all the locking pieces locked to the body 100, the base plate 810 abuts the four projections 211 and 232 on the operating lever 200 inside the body 100, projections on the rotor 300, and the frame 520 of the pressing member 500. Accordingly, the base plate 810 and the body 100 hold therebetween the operating lever 200, the rotor 300, the brush 420 of the movement detecting part 400, the pressing member 500, and the press switch 600.

The connecting pieces of the upper and lateral locking pieces 820 and 830 and the tip of the lower locking piece 840 are connectable by soldering to a ground pattern (not shown) on the circuit board of the electronic device. As such, static electricity charged on the operating lever 200 can be received at the base 110 and the upper locking pieces 820 to be passed to the ground pattern through the upper, lateral and lower locking pieces 820, 830 and 840.

A description is given below on an assembly procedure of the compound operation input device configured as above. First, the two second legs 652 of the second movable contact 650 of the press switch 600 are positioned and inserted into the respective third supporting portions 134 of the switch housing portion 130. Then, the second legs 652 come into contact with the respective bifurcated first end portions of the second stationary contact 620. Simultaneously therewith, the second contact main body 651 of the second movable contact 650 is set on the contact placing portion 135 of the switch housing portion 130.

Subsequently, the four first legs 642 of the first movable contact 640 of the press switch 600 are positioned and inserted into the recesses of the two first supporting portions 132 and of the two second supporting portions 133 of the switch housing portion 130. Then, the two first legs 642 come into contact with the respective first ends of the first stationary contacts 611 and 612. In this manner, the first contact main body 641 covers the second contact main body 651, and the vertices of the first and second contact main bodies 641 and 651 are arranged with a spaced relation in front of the third stationary contact 630.

Subsequently, the frame 520 of the pressing member 500 is fitted into the housing main portion 131 of the switch housing portion 130. Then, the head 512 of the pressing member 500 abuts the vertex of the first stationary contact 640 of the press switch 600. Simultaneously therewith, the lateral ends of the frame 520 are placed on the first, second, and third supporting portions 132, 133, and 134. Accordingly, the tips of the first legs 642 of the first movable contact 640 and the lateral ends of the second legs 652 of the second movable contact 650 are held between the lateral ends of the frame 520 and the first, second, and third supporting portions 132, 133, and 134.

Meanwhile, the coil springs 700 are housed in the housing recesses 142 of the spring housings 140 in a compressed state.

After that, the rotor 300 attached with the brush 420 is positioned and inserted into the guide 170 of the body 100. Then, the brush 420 abuts the inner surface of the base 110 of the body 100.

Thereafter, the shaft 210 of the operating lever 200 is positioned and inserted into the fitting recess 310 of the rotor 300. Simultaneously therewith, the slope 231 of the operating lever 200 is brought into abutment with the head 512 of the pressing member 500.

Subsequently, the upper locking pieces 820 of the frame ground 800 are locked to the locking projections 151 on the body 100, while the connecting pieces of the upper locking pieces 820 are housed in the upper housing recesses 111 of the body 100. The lateral locking pieces 830 of the frame ground 800 are fitted in the locking recesses 141*a* on the body 100, while the connecting pieces of the lateral locking pieces 830 are housed in the lateral housing recesses 112 on the body 100. The lower locking piece 840 of the frame ground 800 is housed in the recess 121 of the body 100 and is locked to the locking projection 121*a*.

In this manner, the frame ground 800 is attached to the body 100. At this point, the base plate 810 of the frame ground 800 abuts the projections 211 and 232 of the operating lever 200 and the projections of the rotor 300, so that the base plate 810 and the body 100 hold therebetween the operating lever 200, the rotor 300, the brush 420 of the movement detecting part 400, the pressing member 500, and the first and second movable contacts 640 and 650 of the press switch 600.

Thereafter, the body 100 is mounted at its outer surface on the aforementioned circuit board of the electronic device. Then, the second ends of the contacts 411, 412, and 413 of the movement detecting part 400 are soldered to an electrode pattern of the circuit board, whereas the second ends of the first, second, and third stationary contacts 611, 612, 620, and 630 of the press switch 600 are soldered to another electrode pattern of the circuit board.

Simultaneously therewith, the connecting pieces of the upper and lateral locking pieces 820 and 830 and the tip of the lower locking piece 840 of the frame ground 800 are soldered to the ground pattern of the circuit board.

A description will be made below on how to use the compound operation input device assembled as above and the operation of each element of the device.

As shown in FIG. 5B, when the operating lever 200 is operated to make the first depressing movement from the predetermined position, the protrusion 240 of the operating lever 200 moves from the aforementioned initial position toward the recess 162 in the arcuate wall 160. Meanwhile, as shown in FIG. 7B, the slope 231 of the operating lever 200 presses on the head 512 of the pressing member 500. Then, the axial support 511 of the pressing member 500 becomes elastically deformed, and the head 512 moves onto the press switch 600. Further, the head 512 presses the vertex of the first contact main body 641 of the first movable contact 640 of the press switch 600.

The pressure causes elastic deformation of the four first legs 642 and the first contact main body 641, and the vertex of the first contact main body 641 touches the vertex of the second contact main body 651. As a result, the first stationary contacts 611 and 612 and the second stationary contact 620 become electrically connected with the first and second movable contacts 640 and 650—i.e., the press switch 600 has made a first phase switch-on, and a signal of which is outputted to the electronic device.

When the operating lever 200 is then released, the first contact main body 641, the four first legs 642, and the axial support 511 are restored. This restoration force causes the head 512 to move away from the press switch 600 and elevates the slope 231 of the operating lever 200 toward the predetermined position. The operating lever 200 is thus returned to the predetermined position. At this point, the protrusion 240 leaves the recess 162 in the arcuate wall 160 to return to the initial position.

As shown in FIG. 5C, when the operating lever 200 is operated to make the second depressing movement from the predetermined position, the protrusion 240 of the operating lever 200 sinks from the initial position into the recess 162 in arcuate wall 160; while, as shown in FIG. 7C, the slope 231 of the operating lever 200 presses on the head 512 of the pressing member 500. Then, the axial support 511 of the pressing member 500 becomes elastically deformed, and the head 512 moves onto the press switch 600.

Then, the head 512 presses the vertices of the first and second contact main bodies 641 and 651. The four first legs 642 and the first and second contact main bodies 641 and 651 become elastically deformed accordingly, and the vertex of the first contact main body 641 contacts the first end of the third stationary contact 630 via the second contact main body 651. As a result, the first, second, and third stationary contacts 611, 612, 620, and 630 become electrically connected with the first and second movable contacts 640 and 650—i.e., the press switch 600 has made a second phase switch-on, and a signal of which is outputted to the electronic device.

When the operating lever 200 is then released, the first and second contact main bodies 641 and 651, the four first legs 642, and the axial support 511 are restored. This restoration force causes the head 512 to move away from the press switch 600 and elevates the slope 231 of the operating lever 200 toward the predetermined position. The operating lever 200 is thus returned to the predetermined position. At this point, the protrusion 240 makes its way upward out of the recess 162 in the arcuate wall 160 to return to the initial position.

As shown in FIG. 6A, when the operating lever 200 is swung from the predetermined position in a first one of the swing directions D1, the protrusion 240 is moved from the initial position to a position above a first outside edge of the recess 162 in the arcuate wall 160. At the same time, the rotor 300 is swung in the first swing direction D1 together with the operating lever 200 while being guided by the guide 170.

Then, the two contacting arms 422 of the brush 420 touch the contacts 411 and 412, respectively, and signals indicating the touch are outputted to the electronic device.

At this time, one of the arms (first arm) 330 of the rotor 300 advances into a housing recess 142 along the associated guide groove 142*b* of the body 100 to press the associate one of the springs (first spring) 700. The first spring 700 is thus put under compression.

When the operating lever 200 is then released, the first spring 700 urges the first arm 330 of the rotor 300, thereby returning the operating lever 200 and the rotor 300 to the predetermined positions and returning the protrusion 240 to the initial position.

When the operating lever 200 is swung from the predetermined position in the second swing direction D1, each part operates in the same manner as in the swing in the first swing direction D1, except that the two contacting arms 422 of the brush 420 touch the contacts 411 and 413, respectively.

As shown in FIG. 6B, when the operating lever 200 is operated to make the first depressing movement from a position on the swing path in the first swing direction D1 (i.e., a position on the swing path other than the predetermined position), the protrusion 240 of the operating lever 200 comes close to the first outside edge of the recess 162 in the arcuate wall 160, while the slope 231 of the operating lever 200 presses on the head 512 of the pressing member 500. Then, in the same manner as in the above-described first depressing movement from the predetermined position, the head 512 of the pressing member 500 presses the vertex of the first contact main body 641 of the first movable contact 640 of the press switch 600 to provide a first phase switch-on, and a signal of which is outputted to the electronic device.

When the operating lever 200 is then released, the first contact main body 641, the four first legs 642, and the axial support 511 are restored. This restoration force causes the head 512 to move away from the press switch 600 and elevates the slope 231 of the operating lever 200. The protrusion 240 thereby leaves the first outside edge of the recess 162 in the arcuate wall 160. Simultaneously therewith, the first spring 700 urges the first arm 330 of the rotor 300, thereby returning the operating lever 200 and the rotor 300 to the predetermined positions and returning the protrusion 240 to the initial position.

When the operating lever 200 is operated to make the second depressing movement from a position on the swing path in the first swing direction D1 (i.e., a position on the swing path other than the predetermined position), the protrusion 240 of the operating lever 200 abuts against the first outside edge of the recess 162 in the arcuate wall 160, whereby the operating lever 200 is prevented from making further movement than the first depressing movement (i.e., the second depressing movement) from the position on the swing path.

Since the same operation takes place when the operating lever 200 is operated to make the first and second depressing movements while being swung in the second swing direction D1, the description thereof is not given.

In such a compound operation input device, the operating lever 200 is provided with the protrusion 240, and the arcuate wall 160 of the body 100 is provided at its substantial center with the recess 162 adapted to receive the protrusion 240. Therefore, when the operating lever 200 is operated to make the first depressing movement from the predetermined position, the protrusion 240 merely comes close to the recess 162, allowing the first depressing movement of the operating lever 200. When the operating lever 200 is operated to make the second depressing movement from the predetermined position, the protrusion 240 is received in the recess 162, allowing the second depressing movement of the operating lever 200. On the other hand, when the operating lever 200 is depressed from a position on the swing path other than the predetermined position, the first depressing movement is allowed because the protrusion 240 does not abut either outside edge of the recess 162 in the arcuate wall 160 of the body 100 during the first depressing movement of the operating lever 200, whilst the second depressing movement is hindered because the protrusion 240 abuts either outside edge of the recess 162 in the arcuate wall 160 of the body 100 during the second depressing movement of the operating lever 200. Consequently, the operating lever 200 is kept from being erroneously operated to make the second depressing movement when being operated to make the first depressing movement from a position on the swing path other than the predetermined position.

It should also be noted that the compound operation input device is so configured that the operating lever 200 presses the vertices of the first and second movable contacts 640 and 650 of the press switch 600 through the intermediary of the pressing member 500. In this configuration, it is possible to detect the first depressing movement from any position on the swing path of the operating lever 200 without increasing the number of stationary contacts in the body 100, simplifying the internal structure due to the minimum number of stationary contacts. Also, the input device can make input as a first depressing movement at any position on the swing path of the operating lever 200, making the device highly versatile with applicability to various kinds of electronics.

Second Embodiment

Figure 8:
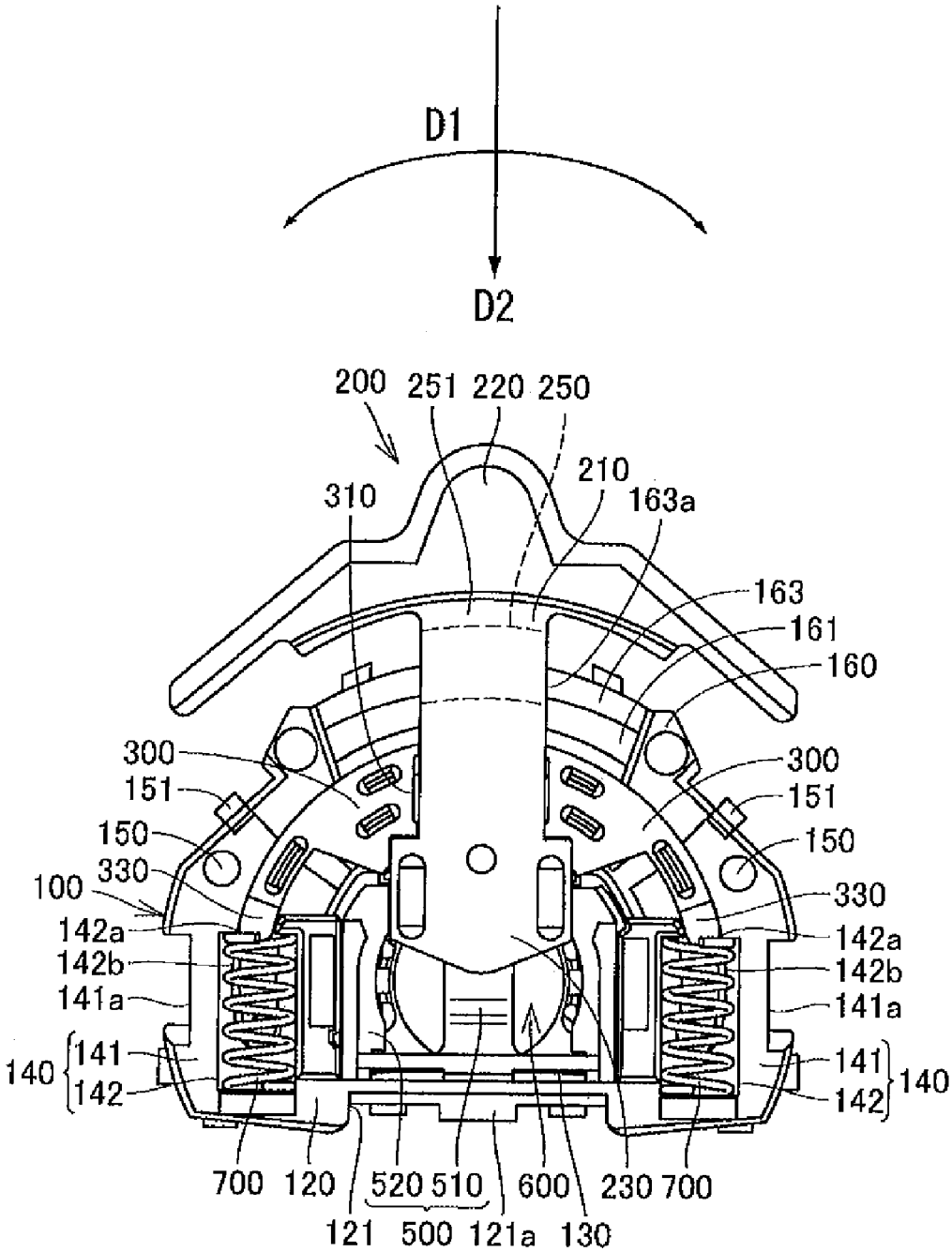
FIG. 8 is a schematic frontal illustration of a compound operation input device according to a second embodiment of the present invention.
Figure 9:
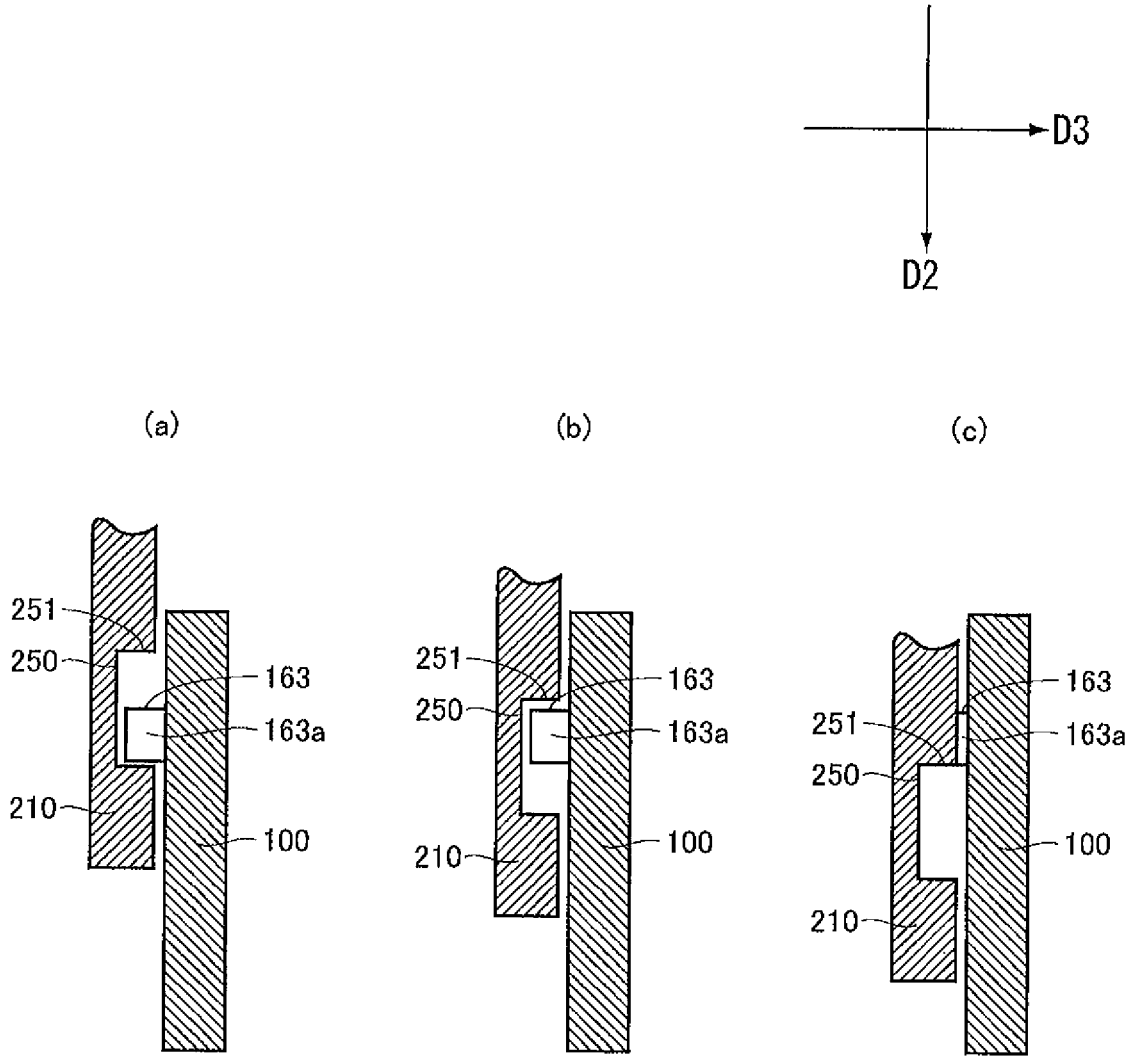
FIGS. 9A to 9C are schematic cross-sectional illustrations of the device showing a relationship between a cutout in an operating lever and a ledge on a body, where
Figure 10:
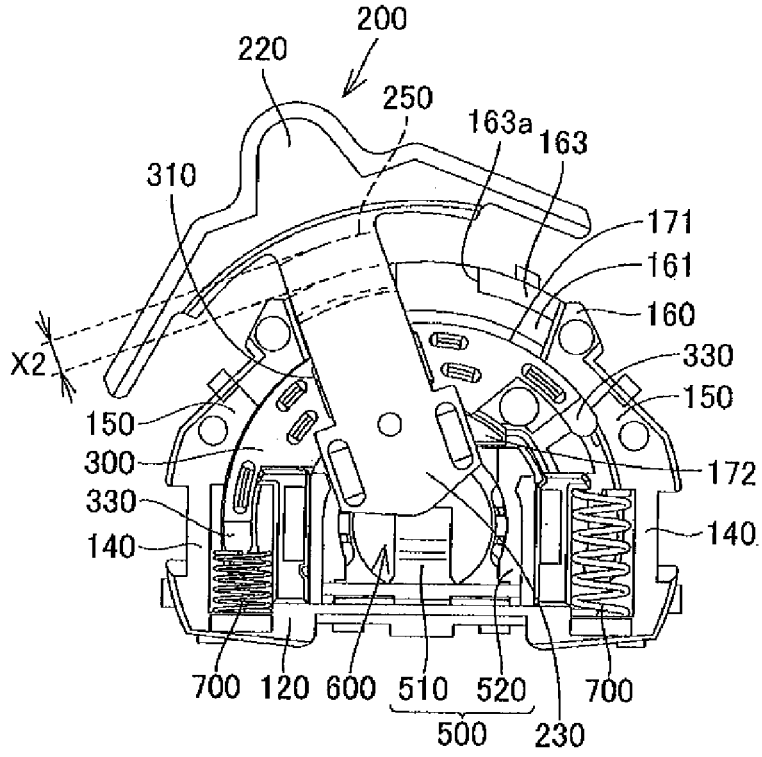
FIGS. 10A and 10B are schematic front views of the device with a cover removed, where
Figure 10:
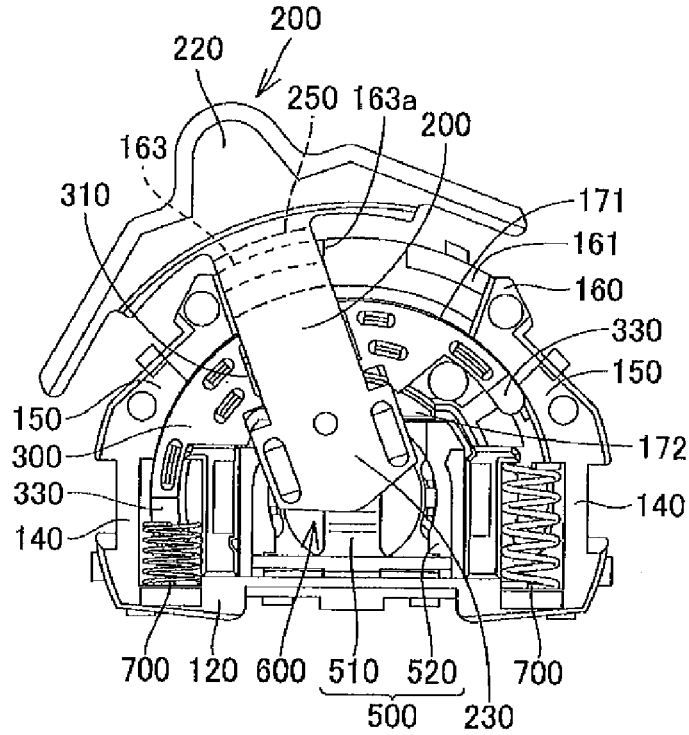

A compound operation input device according to a second embodiment of the present invention is described below with reference to the FIGS. 8 to 10B. FIG. 8 is a schematic frontal illustration of the compound operation input device according to the second embodiment of the present invention. FIGS. 9A to 9C are schematic cross-sectional illustrations of the device showing a relationship between a cutout in an operating lever and a ledge on a body, where FIG. 9A shows a state before depressing operation, FIG. 9B shows a state in which a first depressing movement is made, and FIG. 9C shows a state in which a second depressing movement is made. FIGS. 10A and 10B are schematic front views of the device with a cover removed, where FIG. 10A shows a state in which the operating lever of the device is inclined and FIG. 10B shows a state in which the operating lever in the inclined state of the device has made the first depressing movement.

The compound operation input device shown in FIGS. 8 to 10B is different from the first embodiment in that a ledge 163 (abutting portion) is provided on the body 100 instead of the recess 162, and that a cutout 250 is provided in the operating lever 200 instead of the protrusion 240. The differences are detailed below, and description overlapping between the first and second embodiments is not given.

On the innermost surface (a portion opposite the operating lever) of the guide recess 161 in the arcuate wall 160, the recess 162 is replaced with the arcuate ledge 163 corresponding to the swing path of the operating lever 200. The ledge 163 projects toward the operating lever 200 to be received in the cutout 250. A recess 163*a* is provided in the ledge 163 that penetrates downward from the top of the ledge 163.

In the rear surface of the shaft 210, the protrusion 240 is replaced with the substantially rectangular cutout 250 that is open at its sides. An upper lip 251 of the cutout 250 is slightly smaller in width (i.e., the shaft 210 is smaller in width) than the recess 163*a* in the ledge 163. Thus, the upper lip 251 can be received in the recess 163*a* of the ledge 163.

In a state where the lower end of a basal portion 230 is supported at the predetermined position by a head 512 of a pressing member 500, the upper periphery 251 is located at the position shown in FIGS. 8 and 9A before the upper periphery 251 makes the depressing movement (the position is hereinafter referred to as an initial position).

When the ledge 163 is received in the cutout 250 and the operating lever 200 is swung (i.e., the operating lever 200 is at a position other than a predetermined position on the swing path), the distance X2 between the upper lip 251 and the ledge 163 is set such that the upper lip 251 does not abut against either outside edge of the recess 163*a* in the ledge 163 when the operating lever 200 makes the first depressing movement from the position on the swing path, and that the operating lever 200 abuts against either outside edge of the recess 163*a* in the ledge 163 when the operating lever 200 makes the second depressing movement from the position on the swing path.

A description will be given below on how to use the compound operation input device configured as above and the operation of each element of the device.

As shown in FIG. 9B, when the operating lever 200 is operated to make the first depressing movement from the predetermined position, the upper lip 251 of the cutout 250 in the operating lever 200 moves from the initial position toward the recess 163*a* in the ledge 163. Simultaneously therewith, as in the first embodiment, the slope 231 of the operating lever 200 presses on the head 512 of the pressing member 500, so that the press switch 600 makes a first phase switch-on.

When the operating lever 200 is then released, as in the first embodiment, the operating lever 200 returns to the predetermined position. The upper lip 251 thereby leaves the recess 163*a* in the ledge 163 to return to the initial position.

As shown in FIG. 9C, when the operating lever 200 is operated to make the second depressing movement from the predetermined position, the upper lip 251 of the cutout 250 in the operating lever 200 is received in the recess 163*a* of the ledge 163. Simultaneously therewith, as in the first embodiment, the slope 231 of the operating lever 200 presses on the head 512 of the pressing member 500, so that the press switch 600 makes a second phase switch-on.

When the operating lever 200 is then released, as in the first embodiment, the operating lever 200 returns to the predetermined position. At this point, the upper lip 251 makes its way out of the recess 163*a* in the ledge 163 to return to the initial position.

As shown in FIG. 10A, when the operating lever 200 is swung from the predetermined position in the first swing direction D1, the upper lip 251 of the operating lever 200 moves from the initial position to a position above the first outside edge of the recess 163*a* in the ledge 163. Simultaneously therewith, as in the first embodiment, the rotor 300 is swung in the first swing direction D1, so that the two contacting arms 422 of the brush 420 touch contacts 411 and 412, respectively.

At this point, the first arm 330 of the rotor 300 advances into the housing recess 142 along the guide groove 142*b* on the body 100 to press the first one of springs 700. The first spring 700 is thus put under compression.

When the operating lever 200 is then released, the first spring 700 urges the first arm 330 of the rotor 300, thereby returning the operating lever 200 and the rotor 300 to the predetermined positions and returning the upper lip 251 to the initial position.

When the operating lever 200 is swung from the predetermined position in the second swing direction D1, each part operates in the same manner as in the swing in the first swing direction D1, except that the two contacting arms 422 of the brush 420 touch the contact 411 and the contact 413, respectively. Hence, detailed description will not be given to avoid redundancy.

As shown in FIG. 10B, when the operating lever 200 is operated to make the first depressing movement while at a position on the swing path in the first swing direction D1 (that is, a position other than the predetermined position), the upper lip 251 of the cutout 250 in the operating lever 200 comes close to the first outside edge of the recess 163*a* in the ledge 163. Simultaneously therewith, as in the first embodiment, the slope 231 of the operating lever 200 presses on the head 512 of the pressing member 500, so that the press switch 600 makes a first phase switch-on.

When the operating lever 200 is then released, as in the first embodiment, the restoring force of the first contact main body 641, the four first legs 642, and the axial support 511 brings the operating lever 200 upward. At this point, the upper lip 251 of the cutout 250 in the operating lever 200 leaves the first outside edge of the recess 163*a* in the ledge 163. Simultaneously therewith, as in the first embodiment, the first spring 700 exerts urging force to return the operating lever 200 and the rotor 300 to the predetermined positions and the upper lip 251 of the operating lever 200 to the initial position.

When the operating lever 200 is operated to make the second depressing movement from a position on the swing path in the first swing direction D1 (i.e., a position other than the predetermined position on the swing path), the upper lip 251 of the cutout 250 in the operating lever 200 abuts against the first outside edge of the recess 163*a* in the ledge 163, preventing the operating lever 200 from making further movement than the first depressing movement (i.e., making the second depressing movement) on the swing path.

Since the same operation takes place when the operating lever 200 swung in the second swing direction D1 is operated to make the first and second depressing movements, detailed description thereof will not be given to avoid redundancy.

In the compound operation input device as described above, the operating lever 200 has the cutout 250, and the ledge 163 on the arcuate wall 160 of the body 100 has the recess 163*a* that penetrates downward from the top of the ledge 163 such that the upper lip 251 of the cutout 250 can be received in the recess 163*a*. Therefore, when the operating lever 200 is operated to make the first depressing movement from the predetermined position, the upper lip 251 merely comes close to the recess 163*a* in the ledge 163, allowing the first depressing movement of the operating lever 200. When the operating lever 200 is operated to make the second depressing movement from the predetermined position, the upper lip 251 is received in the recess 163*a* of the ledge 163, allowing the second depressing movement of the operating lever 200. On the other hand, when the operating lever 200 is depressed from a position other than the predetermined position on the swing path, the upper lip 251 does not abut against either outside edge of the recess 163*a* in the arcuate wall 160 of the body 100 during the first depressing movement of the operating lever 200, allowing the first depressing movement; however, the upper lip 251 abuts against either outside edge of the recess 163*a* in the arcuate wall 160 of the body 100 during the second depressing movement of the operating lever 200, hindering the second depressing movement. Hence, the operating lever 200 is kept from being erroneously operated to make the second depressing movement during operation to make the first depressing movement from a position other than the predetermined position on the swing path.

Moreover, the compound operation input device is so configured that the operating lever 200 presses vertices of first and second movable contacts 640 and 650 of the press switch 600 through the intermediary of the pressing member 500. This configuration allows to detect the first depressing movement from any position on the swing path of the operating lever 200 without increasing the number of stationary contacts on the side of the body 100, simplifying the internal structure with the minimum number of stationary contacts. Furthermore, configured to accept input of the first depressing movement from any position on the swing path of the operating lever 200, the input device can be applied to various electronics. That is, the present device can be subjected to a wide variety of use.

Figure 11:
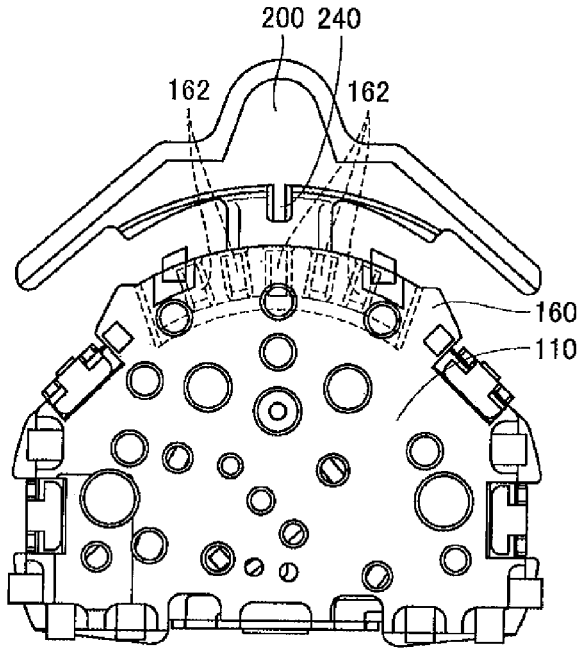
FIGS. 11A to 11C schematically illustrate a modification of the compound operation input device according to the first embodiment, where
Figure 11:
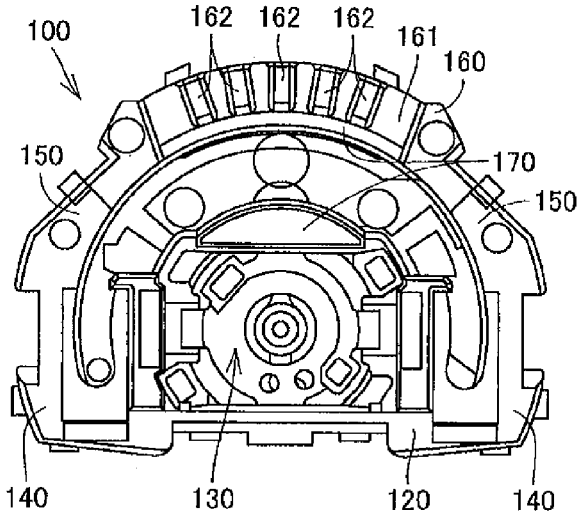
Figure 11:
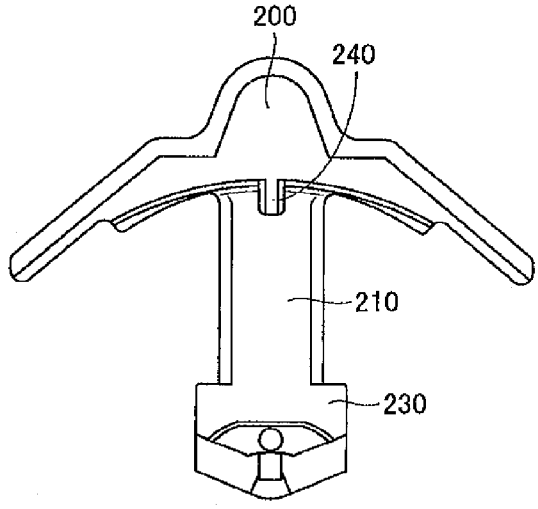
Figure 12:
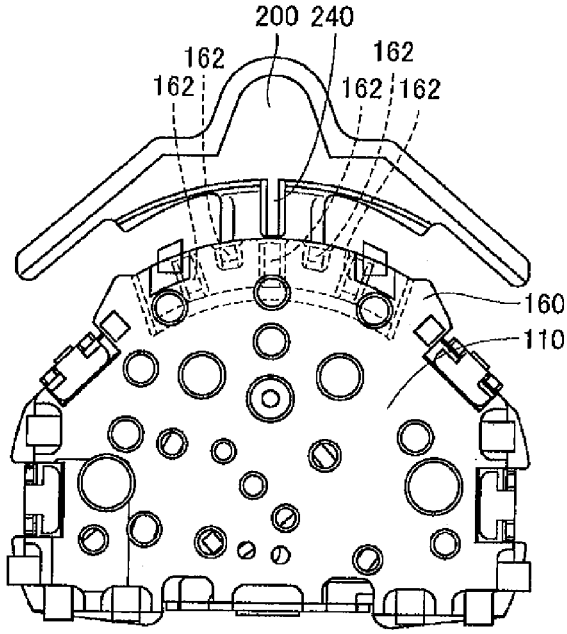
FIGS. 12A to 12C schematically illustrate another modification of the device, where
Figure 12:
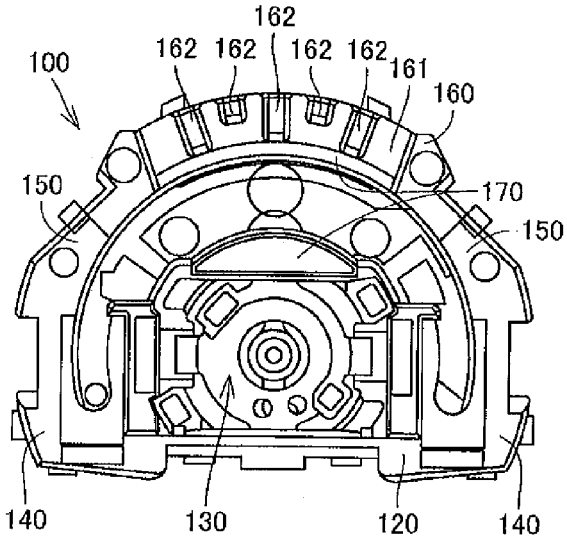
Figure 12:
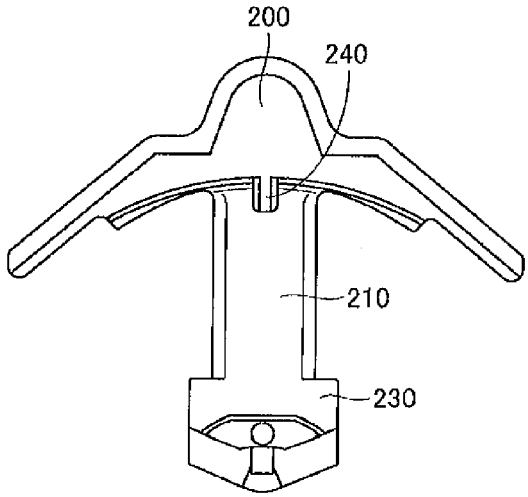
Figure 13:
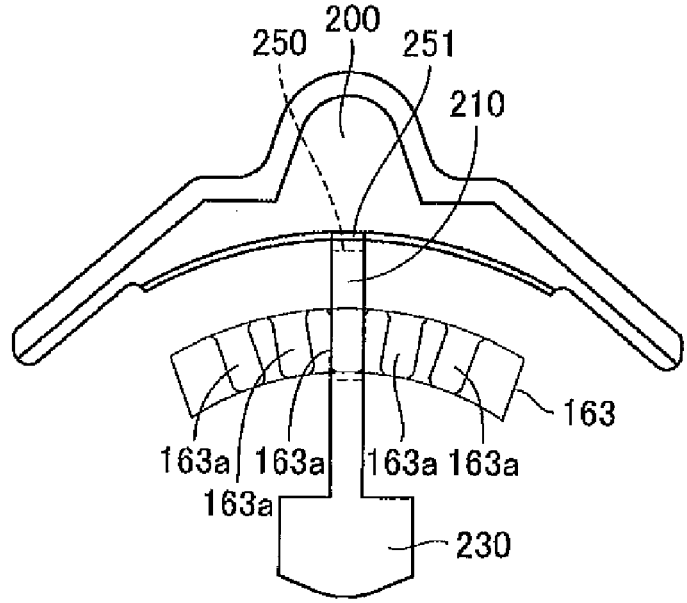
FIGS. 13A and 13B are schematic frontal illustrations of a compound operation input device according to the second embodiment, showing a relationship between an operating lever and a ledge on a body, where
Figure 13:
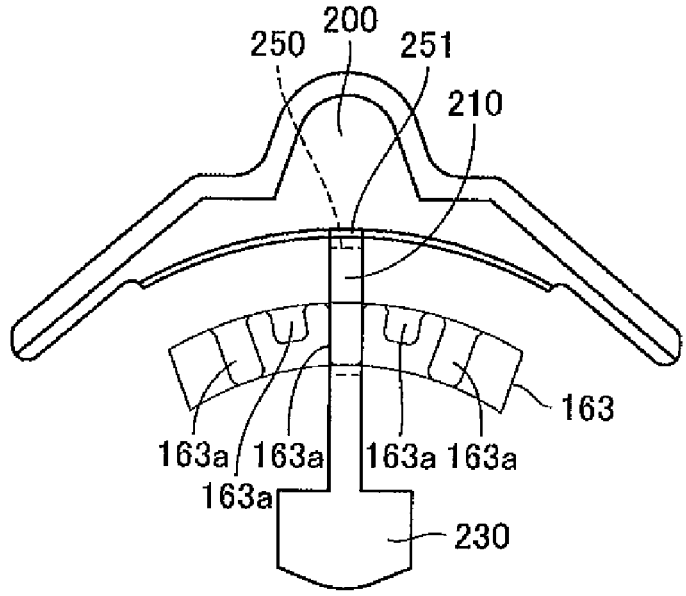
Figure 14:
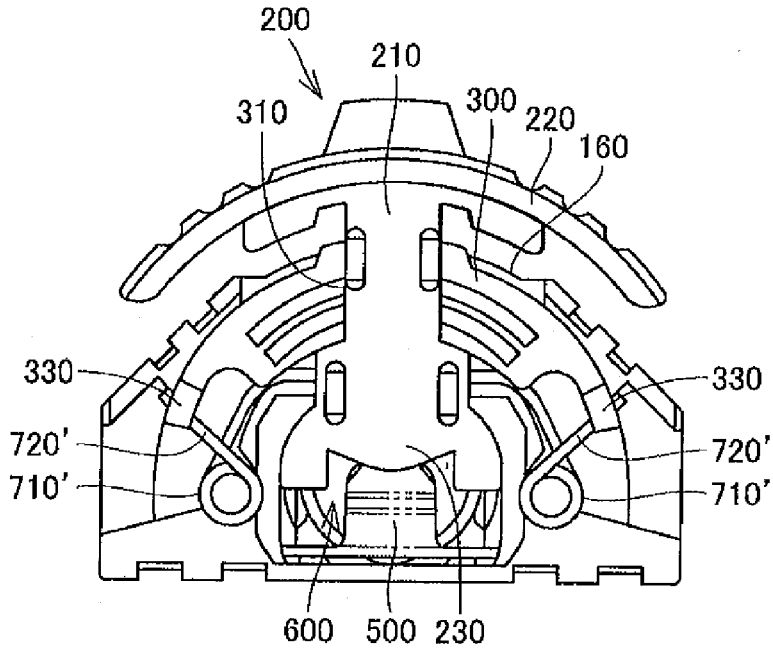
FIGS. 14A and 14B are schematic front views showing a modification of a neutral position restoration mechanism of the operating levers of the compound operation input devices according to the first and second embodiments, where
Figure 14:
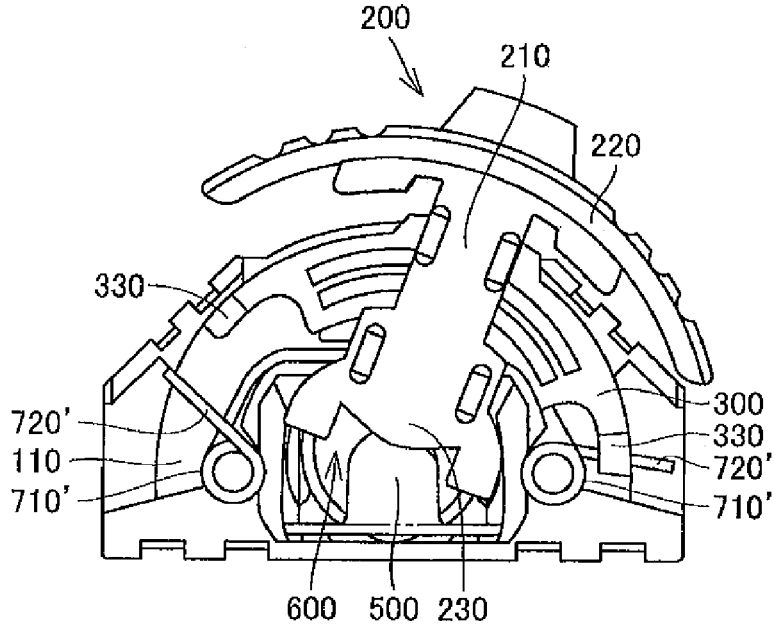

It should be noted that the above-described compound operation input devices may be modified in any suitable manner without departing from the scope of the claims. Modification examples will be described below. FIGS. 11A to 11C schematically illustrate a modification of the compound operation input device according to the first embodiment, where FIG. 11A is a rear view of the modified device, FIG. 11B is a front view of a body thereof, and FIG. 11C is a rear view of an operating lever thereof. FIGS. 12A to 12C schematically illustrate another modification of the device, where FIG. 12A is a rear view of the modified device, FIG. 12B is a front view of a body thereof, and FIG. 12C is a rear view of an operating lever thereof. FIGS. 13A and 13B are schematic frontal illustrations of a compound operation input device according to the second embodiment, showing a relationship between an operating lever and a ledge on a body, where FIG. 13A shows an example in which a plurality of recesses in the ledge have the same shape and FIG. 13B shows an example in which some of the plurality of recesses in the ledge are different in shape from the others. FIGS. 14A and 14B are schematic front views showing a modification of a neutral position restoration mechanism of the operating levers of the compound operation input devices according to the first and second embodiments, where FIG. 14A shows a state in which the operating lever is at a predetermined position and FIG. 14B shows a state in which the operating lever is swung. FIGS. 15A and 15B are schematic illustrations showing another modification of the neutral position restoration mechanism of the operating levers of the compound operation input devices according to the first and second embodiments, where FIG. 15A shows a state in which the operating lever is at a predetermined position and FIG. 15B shows a state in which the operating lever is swung.

In the above-described compound operation input devices, the predetermined position is set to a position at which the operating lever 200 stands substantially upright; however, the predetermined position may be set to any other position on the swing path of the operating lever 200. The predetermined position on the swing path of the operating lever can be changed just by changing the position of the recess of the body. For example, in a case where the predetermined position is set to a position at which the operating lever is inclined at forty-five degrees and the operating lever is adapted to depress the head 512 of the pressing member 500, the predetermined position can be changed merely by changing the position of the recess 162 or the recess 163*a* in the arcuate wall 160 to a position corresponding to the changed predetermined position. Thus, the present device is highly versatile and applicable to various electronics.

Further, a plurality of predetermined positions may be provided on the swing path of the operating lever in the present device. For example, FIGS. 11A to 11C illustrates a case where five recesses 162 are provided in the arcuate wall 160, wherein the operating lever 200 can make the first and second depressing movements from any of the five predetermined positions on its swing path to the head 512 of the pressing member 500, thereby providing the first and second phase switch-ons of the press switch 600. Also, FIG. 13A illustrates a case where five recesses 163*a* are provided in the ledge 163 on the arcuate wall 160, wherein the operating lever 200 can make the first and second depressing movements from any of the five predetermined positions on its swing path to the head 512 of the pressing member 500 to provide the first and second phase switch-ons of the press switch 600. In the above two cases, operation inputs of the first and second depressing movements can be made from a plurality of predetermined positions on the swing path of the operating lever, allowing to perform input of complex depressing operations. The present device can therefore be rendered even more versatile.

The recesses are not limited to ones allowing the first and second depressing movements of the operating lever 200. For example, FIGS. 12A to 12C illustrates a case where out of the five recesses 162 corresponding to the five predetermined positions on the swing path of the operating lever 200, two recesses have such a depth as to allow only the first depressing movement of the operating lever 200. FIG. 13B illustrates a similar case where out of the five recesses 163*a* corresponding to the five predetermined positions on the swing path of the operating lever 200, two recesses have such a depth as to allow only the first depressing movement of the operating lever 200. In these cases, it becomes possible to provide different depressing operation inputs depending on which of the predetermined positions the operating lever is locating at. Consequently, it is possible to provide inputs of complex depressing operations, making the input device even more versatile.

The first embodiment exemplified a case where the arcuate wall 160 serves as the abutting portion. However, the abutting portion may be appropriately modified insofar as it is provided in the body at a position opposite the operating lever and has a substantially arcuate shape. The second embodiment exemplified a case where the ledge 163 serves as the abutting portion. However, the abutting portion may be appropriately modified insofar as it is provided in the body at a position opposite the operating lever and forms a substantially arcuate ledge projecting toward the operating lever.

Further, with the operating lever 200 at a position other than the predetermined position on the swing path, the distance between the protrusion 240 and either outside edge of the recess 162 in the arcuate wall 160 is not limited to as described above, that is, not limited to such a distance that the protrusion 240 does not abut against either outside edge when the operating lever 200 makes the first depressing movement from the position on the swing path, and that the protrusion 240 abuts against either outside edge when the operating lever 200 makes the second depressing movement from the position on the swing path. The distance may be set such that the protrusion 240 abuts against either outside edge when the operating lever 200 makes the first depressing movement from the position on the swing path. In this case also, as described above, it is possible to provide the recess at a different position of the body or to provide a plurality of recesses.

Similarly, with the ledge 163 received in the cutout 250 and the operating lever 200 at a position other than the predetermined position on the swing path, the distance between the upper periphery 251 and the ledge 163 is not limited to as described above, that is, not limited to such a distance that the upper periphery 251 does not abut against either outside edge of the recess 163*a* in the ledge 163 when the operating lever 200 makes the first depressing movement from the position on the swing path, and that the upper periphery 251 abuts against either outside edge of the ledge 163 when the operating lever 200 makes the second depressing movement from the position on the swing path. The distance may be set such that the upper periphery 251 abuts against either outside edge when the operating lever 200 makes the first depressing movement from the position on the swing path. In this case also, as described above, it is possible to provide the recess at a different position of the body or to provide a plurality of recesses.

The operating lever 200 may be appropriately modified as long as it includes a basal portion and an operating portion, the basal portion being disposed on the vertex of the first movable contact of the press switch or on the pressing member, the operating portion projecting outward from the body and being swingable in two opposite swing directions relative to the vertex or the pressing member serving as a fulcrum and being depressible from at least one predetermined position on the swing path toward the press switch.

The slope 231 of the operating lever 200 may be appropriately modified as long as it is adapted to move the pressing member toward the press switch. For example, the slope may be an arcuate surface. It is also possible to provide the slope at the pressing member 500, not at the operating lever. Obviously, the slope may be provided both at the operating lever and the pressing member. Alternatively, the slope may be omitted if the operating lever is adapted to move the pressing member toward the press switch.

The pressing member 500 may be omitted. In this case, the operating lever 200 may be disposed on the vertex of the press switch 600 so as to be depressible toward the press switch. Alternatively, the pressing member 500 may be appropriately modified as long as it can move in a direction substantially orthogonal to the direction of the depressing movement and the swing directions by being pressed by the base in association with a depressing movement of the operating lever so as to press the press switch 600. For example, the pressing member may be a moving member that is movably guided along a guide groove provided in the body so as to move in a thickness direction of the body when pressed by the base of the operating lever, toward the press switch to press the press switch.

The press switch 600 may be appropriately modified as long as it includes a first movable contact having a substantially arcuate cross-sectional shape, a first stationary contact to contact the first movable contact, and a second stationary contact to be contacted by the deformed first movable contact. That is, the press switch may only provide a first phase switch-on.

The first and second movable contacts 640 and 650 only need to have a substantially arcuate cross-sectional shape.

The neutral position restoration mechanism of the operating lever 200 is not limited to the mechanism using the coil springs 700 as described above. For example, FIGS. 14A and 14B illustrate another neutral position restoration mechanism having two coil portions 710' and arm portions 720' extending therefrom, wherein each of the paired arms 330 of the rotor 300 abuts against the associated one of the arm portions 720'. In this case, when the operating lever 200 is swung, one of the arms 330 of the rotor 300 presses the associated arm portion 720', thereby compressing the associated coil portion 710' and providing the rotor 300 with restoration force via the arm portion 720'.

Figure 15:
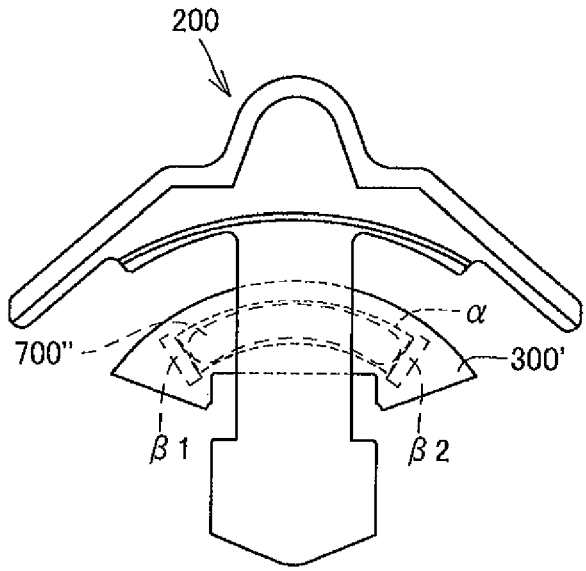
FIGS. 15A and 15B are schematic illustrations showing another modification of the neutral position restoration mechanism of the operating levers of the compound operation input devices according to the first and second embodiments, where
Figure 15:
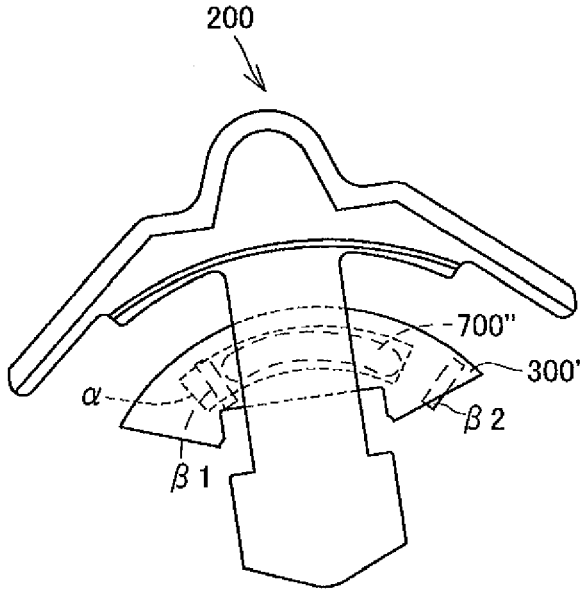

Another alternative example of the neutral position restoration mechanism is shown in FIGS. 15A and 15B. Particularly, a rotor 300' has a housing recess α to house an arcuate elastic member 700" such as a rubber piece or a coil spring, whereas the body has stopping portions β1 and β2 to abut against the lateral ends of the elastic member. In this case, when the operating lever 200 is swung, as illustrated in FIG. 15(*b*), the elastic member 700" is compressed between an end of the housing recess α and a stopping portion β2 to provide the rotor 300' with restoration force. In the reverse fashion, the housing recess α may be provided in the body while the stopping portions β1 and β2 may be provided in the rotor 300'. The neutral position restoration mechanism may be omitted.

The rotor 300 may be omitted. In this case, the operating lever may be provided with a pair of arms to abut against the coil springs 700 or the arms 720', a housing recess α, or stopping portions β1 and β2.

The movement detecting part 400 may be appropriately modified as long as it is capable of detecting swing of the operating lever 200. For example, a magnetic body may be attached to the rotor while providing the body with a Hall element so as to detect a swing of the operating lever through a change in magnetic field corresponding to a movement of the magnetic body. Alternatively, the body may have a resistive pattern, so that when a contactor attached to the rotor slides over the resistive pattern, a change in resistance value occurred is detected as an swing of the operating lever. In this case, it is possible to detect not only a swing of the operating lever but also the amount of the swing, contributing to improved performance of the input device.

The parts of the compound operation input device may be appropriately modified in shape and position as long as the parts can provide functions as described above.

REFERENCE SIGNS LIST

100 BODY
160 ARCUATE WALL (ABUTTING PORTION)
162 RECESS
163 LEDGE (ABUTTING PORTION)
163*a* RECESS
200 OPERATING LEVER
220 OPERATING ARM (OPERATING PORTION)
230 BASAL PORTION
231 SLOPE
240 PROTRUSION
250 CUTOUT
251 UPPER LIP
400 MOVEMENT DETECTING MEANS

500 PRESSING MEMBER
512 HEAD
600 PRESS SWITCH
611, 612 FIRST STATIONARY CONTACT
620 SECOND STATIONARY CONTACT
630 THIRD STATIONARY CONTACT
640 FIRST MOVABLE CONTACT
650 SECOND MOVABLE CONTACT

The invention claimed is:

1. A compound operation input device comprising:

a body;

a press switch disposed in the body, the press switch including a first movable contact in a substantially arcuate cross-sectional shape;

an operating lever including a basal portion, disposed on a vertex of the first movable contact of the press switch, and an operating portion, projecting outward from the body, being swingable in two opposite swing directions relative to the vertex serving as a fulcrum, and being depressible toward the press switch from at least one predetermined position on a swing path of the operating lever; and a movement detecting part, provided in the body to output a signal corresponding to a swing of the operating lever, wherein the body includes a substantially arcuate abutting portion provided in a portion opposite the operating lever, the operating lever includes a protrusion, the protrusion protruding in a direction substantially orthogonal to the swing directions and being disposed above the abutting portion, the abutting portion of the body has at least one recess at a position thereof corresponding to the predetermined position, when the operating lever makes a depressing movement from a position other than the predetermined position, the protrusion abuts against the abutting portion, and when the operating lever makes a depressing movement from the predetermined position, the protrusion is received in the recess of the abutting portion such that the basal portion presses the vertex of the first movable contact.

2. The compound operation input device according to claim 1, further comprising a pressing member, the basal portion of the operating lever being disposed on the pressing member instead of the press switch, wherein the operating lever is adapted to make a depressing movement not toward the press switch but toward the pressing member, upon depression of the pressing member by the basal portion in response to a depressing movement of the operating lever, the pressing member is moved in a direction substantially orthogonal to the direction of the depressing movement and to the swing directions, and the press switch is disposed to oppose the pressing member with the vertex of the first movable contact pointing in an opposite direction to the moving direction of the pressing member.

3. The compound operation input device according to claim 1 or 2, wherein the press switch includes:

first, second and third stationary contacts, provided at the body;

the first movable contact, contacting the first stationary contact; and a second movable contact in a substantially arcuate cross-sectional shape, disposed between the first movable contact and the body to be contactable with the second stationary contact, the second movable contact having a vertex at a position between the vertex of the first movable contact and the third stationary contact, the operating lever is capable of making a first depressing movement, in which the basal portion presses the vertex of the first movable contact directly or through the intermediary of the pressing member, and a second depressing movement, in which the basal portion presses the vertices of the first and second movable contacts directly or through the intermediary of the pressing member, when the vertex of the first movable contact is pressed as a result of the first depressing movement of the operating lever, the first movable contact is elastically deformed and the vertex of the first movable contact contacts the vertex of the second movable contact, and when the vertices of the first and second movable contacts are pressed as a result of the second depressing movement of the operating lever, the first and second movable contacts are elastically deformed and the vertices of the first and second movable contacts contact the third stationary contact.

4. The compound operation input device according to claim 3, wherein the protrusion and the abutting portion are separated by such a distance that, when the operating lever makes the first depressing movement from a position other than the predetermined position, the protrusion does not abut against the abutting portion, and that when the operating lever makes the second depressing movement from a position other than the predetermined position, the protrusion abuts against the abutting portion.

5. The compound operation input device according to claim 3, the predetermined position comprising at least first and second predetermined positions, from which the operating lever is depressible, wherein the recess comprises at least first and second recesses that are located corresponding to the first and second predetermined positions, respectively, in the abutting portion of the body, the first recess has such a depth that, when the operating lever makes the first depressing movement from the first predetermined position, the protrusion does not abut against a bottom of the first recess in the abutting portion, and that when the operating lever makes the second depressing movement from the first predetermined position, the protrusion abuts against the bottom of the first recess in the abutting portion, and the second recess has such a depth that, when the operating lever makes the first and second depressing movements from the second predetermined position, the protrusion does not abut against a bottom of the second recess in the abutting portion during both of the movements.

6. The compound operation input device according to claim 4, the predetermined position comprising at least first and second predetermined positions, from which the operating lever is depressible, wherein the recess comprises at least first and second recesses that are located corresponding to the first and second predetermined positions, respectively, in the abutting portion of the body, the first recess has such a depth that, when the operating lever makes the first depressing movement from the first predetermined position, the protrusion does not abut against a bottom of the first recess in the abutting portion, and that when the operating lever makes the second depressing movement from the first predetermined position, the protrusion abuts against the bottom of the first recess in the abutting portion, and the second recess has such a depth that, when the operating lever makes the first and second depressing movements from the second predetermined position, the protrusion does not abut against a bottom of the second recess in the abutting portion during both of the movements.

7. The compound operation input device according to claim 3, wherein the pressing member is elastically deformable, when the first movable contact is released from pressure directly by the operating lever, the first movable contact is restorable so as to lift the operating lever, and when the first and second movable contacts are released from pressure directly by the operating lever, the first and second movable contacts are restorable so as to lift the operating lever.

8. The compound operation input device according to claim 3, wherein the pressing member is elastically deformable, when the first movable contact is released from pressure through the intermediary of the pressing member, the pressing member and the first movable contact are restorable so as to lift the operating lever, and when the first and second movable contacts are released from pressure through the intermediary of the pressing member, the pressing member and the first and second movable contacts are restorable so as to lift the operating lever.

9. The compound operation input device according to claim 2, wherein at least one of the basal portion of the operating lever and the pressing member has a slope for moving the pressing member toward the press switch upon depression of the operating lever.

10. The compound operation input device according to claim 2, wherein the pressing member is elastically deformable, and when the first movable contact is released from pressure by the operating lever, the pressing member and the first movable contact are restorable so as to lift the operating lever.

11. A compound operation input device comprising:

a body;

a press switch disposed in the body, the press switch including a first movable contact in a substantially arcuate cross-sectional shape;

an operating lever including a basal portion, disposed on a vertex of the first movable contact of the press switch, and an operating portion, projecting outward from the body, being swingable in two opposite swing directions relative to the vertex serving as a fulcrum, and being depressible toward the press switch from at least one predetermined position on a swing path of the operating lever; and a movement detecting part, disposed in the body to output a signal corresponding to a swing of the operating lever, wherein the body includes an abutting portion in a substantially arcuate ledge shape, the abutting portion being arranged to face and project toward the operating lever, the operating lever including a cutout, the cutout facing the body for receiving the abutting portion, the abutting portion of the body having at least one recess at a position thereof corresponding to the predetermined position, when the operating lever makes a depressing movement from a position other than the predetermined position, an upper lip of the cutout abuts against the abutting portion, and when the operating lever makes a depressing movement from the predetermined position, the upper lip of the cutout is received in the recess of the abutting portion in such a manner that the basal portion presses the vertex of the first movable contact.

12. The compound operation input device according to claim 11, further comprising a pressing member, the basal portion of the operating lever being disposed on the pressing member instead of the press switch, wherein the operating lever is adapted to make a depressing movement not toward the press switch but toward the pressing member, upon depression of the pressing member by the basal portion in response to a depressing movement of the operating lever, the pressing member is moved in a direction substantially orthogonal to the direction of the depressing movement and to the swing directions, and the press switch is disposed to oppose the pressing member with the vertex of the first movable contact pointing in an opposite direction to the moving direction of the pressing member.

13. The compound operation input device according to claim 11 or 12, wherein the press switch includes:

first, second and third stationary contacts, provided in the body;

the first movable contact, contacting the first stationary contact; and a second movable contact in a substantially arcuate cross-sectional shape, disposed between the first movable contact and the body to be contactable with the second stationary contact, the second movable contact having a vertex at a position between the vertex of the first movable contact and the third stationary contact, the operating lever is capable of making a first depressing movement, in which the basal portion presses the vertex of the first movable contact directly or through the intermediary of the pressing member, and a second depressing movement, in which the basal portion presses the vertices of the first and second movable contacts directly or through the intermediary of the pressing member, when the vertex of the first movable contact is pressed as a result of the first depressing movement of the operating lever, the first movable contact is elastically deformed and the vertex of the first movable contact contacts the vertex of the second movable contact, and when the vertices of the first and second movable contacts are pressed as a result of the second depressing movement of the operating lever, the first and second movable contacts are elastically deformed and the vertices of the first and second movable contacts contact the third stationary contact.

14. The compound operation input device according to claim 13, wherein the upper lip of the cutout and the abutting portion are separated by such a distance that, when the operating lever makes the first depressing movement from a position other than the predetermined position, the upper lip does not abut against the abutting portion, and that when the operating lever makes the second depressing movement from a position other than the predetermined position, the upper lip abuts against the abutting portion.

15. The compound operation input device according to claim 14, the predetermined position comprising at least first and second predetermined positions, from which the operating lever is depressible, wherein the recess comprises at least first and second recesses that are located corresponding to the first and second predetermined positions, respectively, in the abutting portion of the body, the first recess has such a depth that, when the operating lever makes the first depressing movement from the first predetermined position, the upper lip of the cutout does not abut against a bottom of the first recess in the abutting portion, and that when the operating lever makes the second depressing movement from the first predetermined position, the upper lip of the cutout abuts against the bottom of the first recess in the abutting portion, and the second recess has such a depth that, when the operating lever makes the first and second depressing movements from the second predetermined position, the upper lip of the cutout does not abut against a bottom of the second recess in the abutting portion during both of the movements.

16. The compound operation input device according to claim 13, the predetermined position comprising at least first and second predetermined positions, from which the operating lever is depressible, wherein the recess comprises at least first and second recesses that are located corresponding to the first and second predetermined positions, respectively, in the abutting portion of the body, the first recess has such a depth that, when the operating lever makes the first depressing movement from the first predetermined position, the upper lip of the cutout does not abut against a bottom of the first recess in the abutting portion, and that when the operating lever makes the second depressing movement from the first predetermined position, the upper lip of the cutout abuts against the bottom of the first recess in the abutting portion, and the second recess has such a depth that, when the operating lever makes the first and second depressing movements from the second predetermined position, the upper lip of the cutout does not abut against a bottom of the second recess in the abutting portion during both of the movements.

17. The compound operation input device according to claim 13, wherein the pressing member is elastically deformable, when the first movable contact is released from pressure directly by the operating lever, the first movable contact is restorable so as to lift the operating lever, and when the first and second movable contacts are released from pressure directly by the operating lever, the first and second movable contacts are restorable so as to lift the operating lever.

18. The compound operation input device according to claim 13, wherein the pressing member is elastically deformable, when the first movable contact is released from pressure through the intermediary of the pressing member, the pressing member and the first movable contact are restorable so as to lift the operating lever, and when the first and second movable contacts are released from pressure through the intermediary of the pressing member, the pressing member and the first and second movable contacts are restorable so as to lift the operating lever.

19. The compound operation input device according to claim 12, wherein at least one of the basal portion of the operating lever and the pressing member has a slope for moving the pressing member toward the press switch upon depression of the operating lever.

20. The compound operation input device according to claim 12, wherein the pressing member is elastically deformable, and when the first movable contact is released from pressure by the operating lever, the pressing member and the first movable contact are restorable so as to lift the operating lever.

* * * * *